US006803163B2

(12) United States Patent
Mitsumori et al.

(10) Patent No.: US 6,803,163 B2
(45) Date of Patent: Oct. 12, 2004

(54) ELECTROPHOTOGRAPHIC PHOTORECEPTOR

(75) Inventors: Teruyuki Mitsumori, Kanagawa (JP); Akiteru Fujii, Kanagawa (JP); Mamoru Nozomi, Kanagawa (JP); Satoshi Kato, Kanagawa (JP); Yuuta Kumano, Kanagawa (JP)

(73) Assignee: Mitsubishi Chemical Corporation, Tokyo (JP)

( * ) Notice: Subject to any disclaimer, the term of this patent is extended or adjusted under 35 U.S.C. 154(b) by 23 days.

(21) Appl. No.: 10/452,283

(22) Filed: Jun. 3, 2003

(65) Prior Publication Data

US 2003/0224270 A1 Dec. 4, 2003

Related U.S. Application Data

(62) Division of application No. 10/246,628, filed on Sep. 19, 2002, now Pat. No. 6,599,671, which is a division of application No. 09/739,336, filed on Dec. 19, 2000, now Pat. No. 6,482,560.

(30) Foreign Application Priority Data

Dec. 20, 1999 (JP) ..... 11-360590
Feb. 22, 2000 (JP) ..... 2000-044314
Mar. 10, 2000 (JP) ..... 2000-065896

(51) Int. Cl.[7] ..... G03G 15/02
(52) U.S. Cl. ..... 430/58.05; 430/59.6; 430/96
(58) Field of Search ..... 430/58.05, 59.6, 430/96

(56) References Cited

U.S. PATENT DOCUMENTS 4,766,048 A * 8/1988 Hisamura ..... 430/58.05
4,946,766 A * 8/1990 Fukagai ..... 430/60
5,804,344 A 9/1998 Mitsumori
5,932,384 A 8/1999 Mitsumori
6,482,560 B2 11/2002 Mitsumori et al.

OTHER PUBLICATIONS

Derwent Abstract, JP 10288845 A, 10/1998.

* cited by examiner

*Primary Examiner*—Mark A. Chapman
(74) *Attorney, Agent, or Firm*—Oblon, Spivak, McClelland, Maier & Neustadt, P.C.

(57) ABSTRACT

A high-sensitivity and long-life electrophotographic photoreceptor comprising an electroconductive substrate and at least a photosensitive layer on the electroconductive substrate is provided, wherein the photosensitive layer contains a polyarylate resin not having a nitrogen atom in its repeating unit, and the Hall mobility at an electric field strength of $3\times10^5$ (V/cm) and at a temperature of 21° C. of the photosensitive layer is $3\times10^{-6}$ ($cm^2/Vs$) or more.

6 Claims, No Drawings

ELECTROPHOTOGRAPHIC PHOTORECEPTOR

This application is a Division of application Ser. No. 10/246,628 filed on Sep. 19, 2002 now U.S. Pat. No. 6,599,671, which is a Divisional of Ser. No. 09/739,336 filed Dec. 19, 2000, now U.S. Pat. No. 6,482,560.

BACKGROUND OF THE INVENTION

1. Field of the Invention

The present invention relates to an electrophotographic photoreceptor.

More particularly, it relates to an electrophotographic photoreceptor excellent in abrasion resistance, surface slip characteristics, and the like, and having good electric response characteristics.

2. Description of the Related Art

An electrophotographic technology has found widespread applications not only in the field of a copying machine, but also in the field of various printers in recent years because it can provide an image of immediacy and high quality.

As for the photoreceptor which is the core of the electrophotographic technology, there have been developed photoreceptors using, as the photoconductive materials, conventional inorganic photoconductors such as selenium, arsenic-selenium alloy, cadmium sulfide, and zinc oxide, and in recent years, organic photoconductive materials having advantages of entailing no pollution, ensuring easy film-forming, being easy to manufacture, and the like.

As the organic photoreceptors, there are known a so-called dispersion type photoreceptor obtained by dispersing a photoconductive fine powder in a binder rein, and a lamination type photoreceptor obtained by laminating a charge generation layer and a charge transport layer. The lamination type photoreceptor has a high possibility of ranking as a dominant photoreceptor because a high sensitivity photoreceptor can be provided by using a charge generation material and a charge transportmaterial each having a high efficiency in combination, a high safety photoreceptor can be obtained because of its wide material selection range, and it is relatively advantageous in terms of cost due to its high productivity of coating. Therefore, it has been vigorously developed and has gone into actual use.

The electrophotographic photoreceptor is repeatedly used in an electrophotographic process, i.e., in cycles of charging, exposure, development, transfer, cleaning, charge removal, and the like, during which it is subjected to various stresses to be deteriorated. Such deterioration include chemical or electrical deterioration due to the following facts. That is, strongly oxidizing ozone or $NO_x$ arisen from, for example, a corona charger commonly used as a charger causes a chemical damage to a photosensitive layer, carriers (current) generated upon image exposure passes through the inside of the photosensitive layer, a photosensitive composition is decomposed by charge-removed light, or light from the outside Further, as other deterioration than such deterioration, there is mechanical deterioration of abrasion or occurrence of flaws on the surface of the photosensitive layer, or peeling off of a film due to rubbing with a cleaning blade, a magnetic brush, or the like, contact with a developing agent or paper, and the like. Especially, such damage occurring on the photosensitive layer surface tends to become evident on the copied image. Accordingly, it directly damages the image quality and hence it is largely responsible for restricting the life of the photoreceptor. Namely, the enhancement of the electrical and chemical durability as well as the enhancement of the mechanical strength are essential conditions for developing a long-life photoreceptor.

In general, it is a charge transport layer that receives such a load in the case of the lamination type photoreceptor. The charge transport layer generally comprises a binder resin and a charge transport material. It is the binder resin that substantially determines the strength. However, since the amount of the charge transport material to be doped is considerably large, a sufficient mechanical strength has not yet been achieved.

Further, there has been a demand for a material adaptable to a higher-speed electrophotographic process to meet a growing need for a higher-speed printing. In this case, the photoreceptor is required not only to have a high sensitivity and a long life, but also to have good response characteristics so as to reduce the length of time between exposure and development thereof. It is known that, although the response characteristics are controlled by the charge transport layer, especially the charge transport material, it is also largely changed by the binder resin.

As conventional binder resins of the charge transport layer, there have been used thermoplastic resins and various thermosetting resins, including vinyl polymers such as polymethyl methacrylate, polystyrene, and polyvinyl chloride, and copolymers thereof, polycarbonate, polyester, polysulfone, phenoxy, epoxy, and silicone resins. The polycarbonate resin has a relatively excellent performance out of a large number of the binder resins, and hence various carbonate resins have been developed and have gone into actual uses of ar. For example, JP-A-50-98332 (the term "JP-A" as used herein means an "unexamined published Japanese patent application") discloses bisphenol P type polycarbonates, JP-A-59-71057 discloses bisphenol Z type polycarbonates, JP-A-59-184251 discloses copolymer type polycarbonates of bisphenol P and bisphenol A, and JP-A-5-21478 discloses a polycarbonate copolymer including a structure of bis(4-hydroxyphenyl)ketone type, as binder resins, respectively. However, in actuality, since the conventional organic photoreceptors have drawbacks that the surface is worn and the flaws on the surface occurs due to loads applied in use, such as development with toner, friction with paper, and abrasion by the cleaning member (blade), they have only the restricted printing performances in actual use.

On the other hand, in JP-A-56-135844, there is disclosed the technology of the electrophotographic photoreceptor using a polyarylate resin of the following structure as a binder, commercially available under the trade name "U-polymer". In the publication, it is shown that the electrophotographic photoreceptor thus disclosed is particularly excellent in sensitivity as compared with the one using polycarbonate.

Further, in JP-A-10-288845, it is disclosed that use of a polyarylate using a bisphenol component of a specific structure as the binder resin improves the solution stability in manufacturing the photoreceptor. In JP-A-10-288846, it is shown that the electrophotographic photoreceptor using the polyarylate resin having a specific kinematic viscosity range is excellent in the mechanical strength, especially the abrasion resistance.

However, when currently available polycarbonate resins are used for the electrophotographic process, in many cases, they are still unsatisfactory in the abrasion resistance, the scratching resistance, the response characteristics, the adhesion with a substrate, and the like.

Further, with a commercially available polyarylate resin "U-polymer", there can be observed some improvement in the abrasion resistance and the sensitivity. However, the stability of the coating solution is inferior, and hence it is impossible to coat the solution for manufacturing a photoreceptor.

Still further, although the solubility/solution stability, the mechanical strength, and the like are improved by using the polyarylate resin of a specific structure, the electric characteristics, especially the response characteristics have been unsatisfactory because of a recent growing demand for a higher-speed printing. Therefore, the amount of the charge transport material to be used is required to be increased for overcoming these deficiencies. However, if the content of the charge transport material in the photosensitive layer is increased, the mechanical strength is reduced. Accordingly, there has been a problem that the mechanical characteristics typical of the polyarylate resin cannot be manifested.

Therefore, in actuality, there has been a demand for a binder resin which ensures an excellent mechanical strength, is easy to dissolve in a non-halogen solvent, and excellent in the solution stability, and excellent in the response characteristics.

SUMMARY OF THE INVENTION

Under such circumstances, the present inventors have conducted a close study on the binder resin to be used for the photosensitive layer. As a result, they have found the following facts. That is, by using a polyarylate resin with a specific structure as the binder resin, sufficient mechanical characteristics are ensured, and a high solubility in a non-halogen solvent is also ensured, and the stability of the coating solution is improved, and excellent electric characteristics, especially excellent response characteristics are ensured. Further, by using a specific charge transport material in combination, it is possible to improve the electric characteristics without increasing the amount of the charge transport material to be used. Consequently, it is possible to obtain a photoreceptor satisfying both the mechanical characteristics and the electric characteristics. Thus, they have completed the present invention.

A first aspect of the present invention relates to an electrophotographic photoreceptor having at least a photosensitive layer on an electroconductive substrate, wherein the photosensitive layer contains a polyarylate resin not having a nitrogen atom in its repeating unit and has a Hole mobility of $3\times10^{-6}$ ($cm^2/Vs$) or more at an electric field strength of $3\times10^5$ (V/cm) and at a temperature of 21° C.

A second aspect of the present invention relates to an electrophotographic photoreceptor having at least a photosensitive layer on an electroconductive substrate, wherein the photosensitive layer contains a charge transport material having a polarizability $\alpha$ satisfying:

$$\alpha>100\ (\text{Å}^3)$$

and a polyarylate resin.

A third aspect of the present invention relates to an electrophotographic photoreceptor having at least a photosensitive layer on an electroconductive substrate, wherein the photosensitive layer comprises a polyarylate resin and a charge transport material, and the charge transport material has a polarizability $\alpha$ of a calculated value $\alpha cal$ of the formula:

$$\alpha cal>70\ (\text{Å}^3)$$

by structure-optimization calculation using PM3 or AM1 parameter of MOPAC93 of the charge transport material.

DETAILED DESCRIPTION OF THE PREFERRED EMBODIMENTS (Electroconductive Substrate)

As an electroconductive substrate, there are mainly used, for example, metallic materials such as aluminum, aluminum alloy, stainless steel, copper, and nickel, resin materials in which a conductive powder such as a metal, carbon, or tin oxide has been added for ensuring an electroconductivity, a resin, glass, or paper with a conductive material such as aluminum, nickel, or ITO (indium oxide-tin oxide alloy) deposited or coated on its surface, or the like. They are used in drum form, sheet form, belt form, or the like. Alternatively, there may also be used the one obtained by coating a conductive material having an appropriate resistance value on an electroconductive substrate made of a metallic material for controlling the conductivity and the surface properties, or covering the defects.

When the metallic material such as an aluminum alloy is used as the electroconductive substrate, it may also be used after having undergone an anodic oxidation treatment, or a film formation treatment. When it is subjected to the anodic oxidation treatment, it is desirably subjected to a sealing treatment by a known method.

The substrate surface may be either smooth, or roughened by using a particular cutting method, or carrying out a polishing treatment. Further, it may also be the one roughened by mixing particles with an appropriate particle size in the material constituting the substrate.

(Undercoat Layer)

An undercoat layer may be provided between the electroconductive substrate and the photosensitive layer for improving the adhesion, the blocking tendency, and the like.

The undercoat layer usable may be a resin, the one obtained by dispersing particles of a metal oxide or the like in a resin, and the like.

Examples of the metal oxide particles for use in the undercoat layer include particles of a metal oxide including one metallic element such as titanium oxide, aluminum oxide, silicon oxide, zirconium oxide, zinc oxide, or iron oxide; and particles of a metal oxide including a plurality of metallic elements such as calcium titanate, strontium titanate, and barium titanate. These particles may be used singly, or in mixture of a plurality thereof. Out of these metallic oxide particles, the titanium oxide and the aluminum oxide are preferred, and the titanium oxide is particularly preferred. The titanium oxide particles may be surface-treated by inorganic substances such as tin oxide, aluminum oxide, antimony oxide, zirconium oxide, and silicon oxide, or organic substances such as stearic acid, polyol, and silicone. Any crystalline form of the titanium oxide particles such as rutile-, anatase-, brookite-, or amorphous-form may be used. A plurality of crystalline forms may also be included therein.

Further, although the particle size of the metal oxide particles usable may be various ones, among them, it is preferably from 10 to 100 nm, and in particular, it is preferably from 10 to 25 nm as the average primary particle size in view of the characteristics and the solution stability.

The undercoat layer is desirably formed into the structure in which the metal oxide particles are dispersed in the binder resin. Examples of the binder resin for use in the undercoat layer include phenoxy, epoxy, polyvinylpyrrolidone, polyvinyl alcohol, casein, polyacrylic acid, celluloses, gelatin, starch, polyurethane, polyimide, and polyamide, and they can be used respectively alone, or in a cured form with a curing agent. Among them, alcohol-soluble copolymerized polyamide, modified polyamide, or the like is preferred in that it exhibits good dispersibility and coating property.

The amount of the inorganic particles to be added to the binder resin can be optionally selected, but it is preferably in the range of from 10 to 500 wt % in view of the stability and the coating property of the dispersion.

The film thickness of the undercoat layer can be optionally selected, but it is preferably from 0.1 to 20 $\mu$m in view of the photoreceptor characteristics and the coating property. Further, a known antioxidant or the like may also be added to the undercoat layer.

(Photosensitive Layer)

The electrophotographic photoreceptor of the present invention has at least a photosensitive layer on an electroconductive substrate, and the photosensitive layer contains a polyarylate resin having no nitrogen atom in its repeating unit, and has a Hole mobility of $3\times10^{-6}$ ($cm^2/Vs$) or more, preferably $4\times10^{-6}$ ($cm^2/Vs$) or more, at an electric field strength of $3\times10^5$ (V/cm) and at a temperature of 21° C.

Especially, for satisfying the characteristics at low temperatures, the photosensitive layer preferably has a Hole mobility at an electric field strength of $3\times10^5$ (V/cm) and at a temperature of 5° C. of $1\times10^{-6}$ ($cm^2/Vs$) or more, more preferably $1.5\times10^{-6}$ ($cm^2/Vs$) or more.

Further, as described later, when a polyarylate resin and a polycarbonate resin are used in combination, the Hole mobility at an electric field strength of $3\times10^5$ (V/cm) and at a temperature of 21° C. of the photosensitive layer is preferably $8\times10^{-6}$ ($cm^2/Vs$) or more, and more preferably $2\times10^{-5}$ ($cm^2/Vs$) or more. Further, in this case, the Hole mobility at an electric field strength of $3\times10^5$ (V/cm) and at a temperature of 5° C. is preferably $2\times10^{-6}$ ($cm^2/Vs$) or more, more preferably $3\times10^{31\ 6}$ ($cm^2/Vs$) or more, and most preferably $5\times10^{-6}$ ($cm^2/Vs$) or more.

(1) Layer Structure

As the concrete configuration of the photosensitive layer, there can be mentioned the following type of photoreceptors as examples of basic forms:

- a lamination-type photoreceptor so configured that, on an electroconductive substrate, a charge generation layer containing a charge generation material as a main component, and a charge transport layer containing a charge transport material and a binder resin as main components are laminated in this order;
- a reversed two layer type photoreceptor so configured that, on an electroconductive substrate, a charge transport layer containing a charge transport material and a binder resin as main components and a charge generation layer containing a charge generation material as a main component are laminated in this order; and
- a monolayer (dispersion) type photoreceptor so configured that, on an electroconductive substrate, a layer containing a charge transport material and a binder resin is laminated, and a charge generation material is dispersed in the layer.

(2) Polyarylate Resin (2-1) Structure of a Polyarylate Resin

The polyarylate resin used in the photosensitive layer of the electrophotographic photoreceptor of the present invention (the charge transport layer for the lamination type photoreceptor) does not have a nitrogen atom in its repeating unit. The reason for this is as follows. As the nitrogen atom, there are sp1 nitrile groups, sp2 pyridines, Shiff bases, sp3 amines, or the like, but any of them is difficult to match with the charge transport material to be mixed with polyarylate.

Preferred polyarylate resin is the one having the polyarylate structure represented by the following general formula (2):

(2)

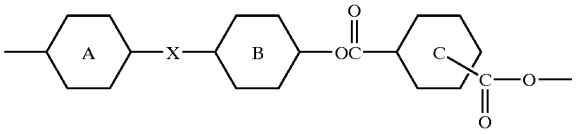

In the general formula (2) rings A, B, and C each represent a benzene ring which may have 1 to 4 substituents, and X represents a divalent organic group.

Among them, the polyarylate resin represented by the general formula (2) having structural units of the following general formulae (3) and (4) is preferred.

(3)

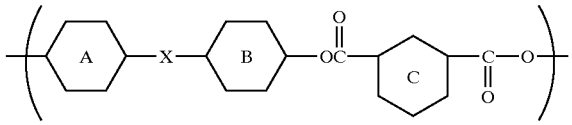

(4)

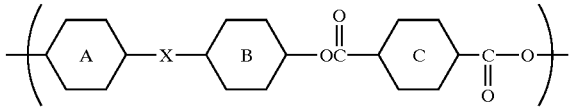

Assuming that the molar ratios of the structural units of (3) to (4) are m and n, respectively, the molar ratios of both the components in the polyarylate resin is preferably the value satisfying the following formula:

$$0.5 \leqq n/(m+n) \leqq 1$$

Further, from the viewpoint of the electric characteristics, the larger the amount of the terephthalic acid unit is, the more preferable it is, and the following range is preferred:

$$0.6 \leqq n/(m+n) \leqq 1$$

The following range is more preferred:

$$0.7 \leqq n/(m+n) \leqq 1$$

The following range is most preferred:

$$0.8 \leqq n/(m+n) \leqq 1$$

If the value of n/(m+n) is too small, the resulting photoreceptor has reduced electric characteristics, especially reduced response characteristics.

In the general formula (2), the rings A, B, and C each represent a benzene ring which may have 1 to 4 substituents. Examples of the substituents include, each independently, any of a hydrogen atom, an alkyl group having 1 to 6 carbon atoms, an alkoxyl group having 1 to 4 carbon atoms, a halogen atom, a halogenated alkyl group, an aromatic group having 6 to 20 carbon atoms which may have a substituent.

Examples of the alkyl group having 1 to 6 carbon atoms include methyl, ethyl, n-propyl, isopropyl, n-butyl, isobutyl, sec-butyl, tert-butyl, n-pentyl, sec-pentyl, and n-hexyl groups. Examples of the alkoxy group having 1 to 4 carbon atoms include methoxy, ethoxy, n-propoxy, and n-butoxy groups. Further, examples of halogen include chlorine, bromine, and fluorine atoms, and examples of the halogenated alkyl group include chloromethyl, dichloromethyl, trichloromethyl, and trifluoromethyl groups. Examples of the aromatic group which may have a substituent include phenyl, 4-methylphenyl, and naphthyl groups. Among them, as the substituent of the rings A and B, the hydrogen atom, methyl and phenyl groups are preferably used, and in particular, the methyl group is preferably used. Further, the rings A and B are each most preferably a benzene ring having two methyl groups. Still further, the ring C is preferably an unsubstituted benzene ring.

In general, X is selected from a single bond, the structures represented by the following general formula (5) —O—, —S—, —CO—, —$SO_2$—, and —$(CH_2)$—, where s is an integer of 2 or more, and preferably an integer of from 2 to 5. Among them, the structure represented by the following general formula (5) is preferred.

(5)

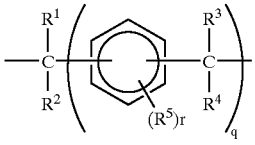

In the general formula (5), $R^1$, $R^2$, $R^3$, $R^4$, and $R^5$ each independently represent a hydrogen atom, an alkyl group having 1 to 6 carbon atoms, an alkoxyl group having 1 to 4 carbon atoms, a halogen atom, a halogenated alkyl group, or an aromatic group having 6 to 20 carbon atoms which may have a substituent. Specific examples thereof are identical with the foregoing ones. Further, $R^1$ and $R^2$, and $R^3$ and $R^4$ may be mutually combined to form rings, respectively. Among them, any of a hydrogen atom, methyl group, phenyl group, or the one in which $R^1$ and $R^2$ are combined to form a cyclohexyl ring is preferred, and a hydrogen atom is particularly preferred.

Further, q is generally an integer of 0 or more, and preferably 0 or 1, and in particular, preferably q=0, and r generally denotes an integer of from 0 to 4.

Below, specific examples of the general formula (2) will be shown. The polyarylate resin of the present invention preferably contains at least two kinds of the structures represented by P-1 to P-61, and M-1 to M-36 in the following specific examples. Further, it more preferably contains at least two kinds of the structures represented by P-1 to P-61 for improving the electric characteristics.

P-1

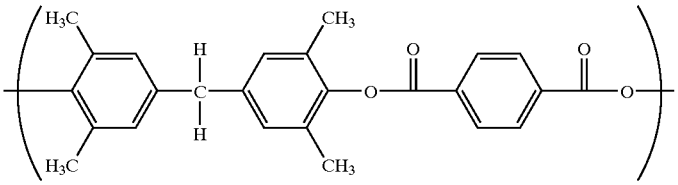

P-2

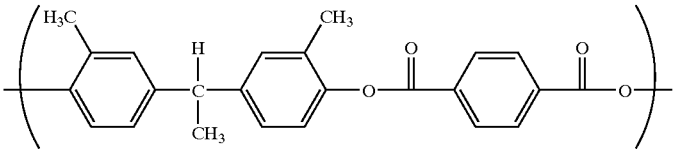

P-3

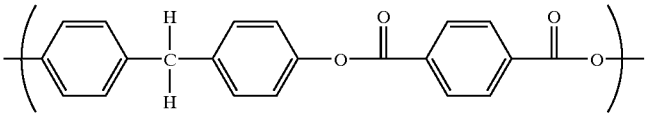

P-4

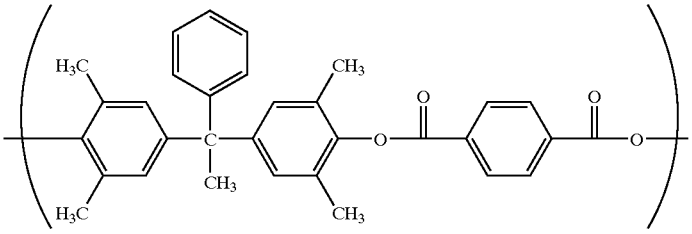

P-5

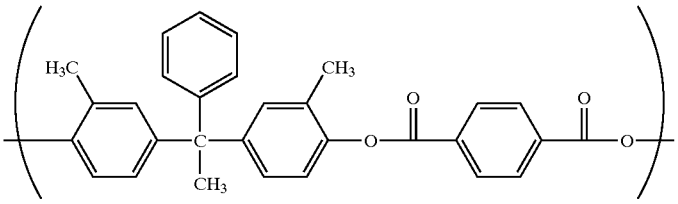

-continued
P-6
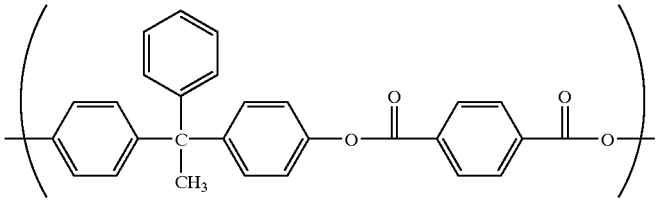
P-7
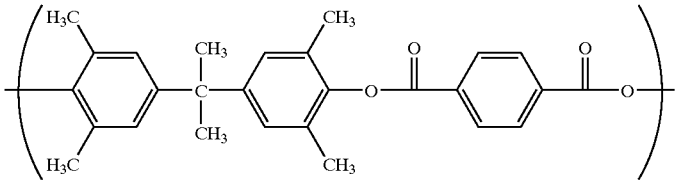
P-8
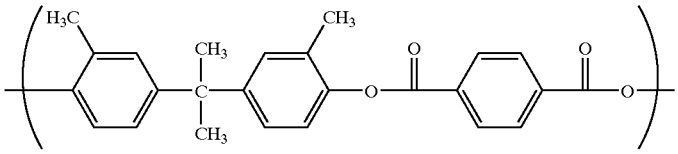
P-9
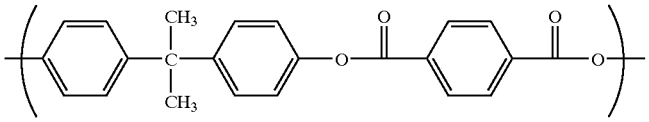
P-10
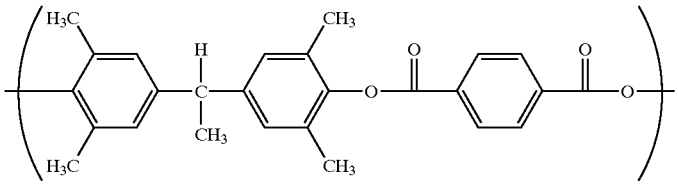
P-11
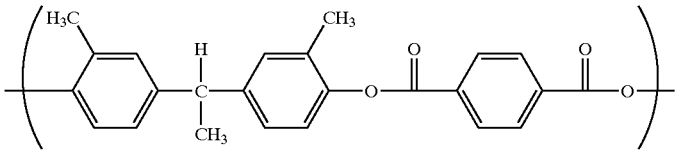
P-12
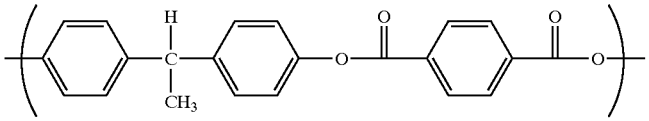
P-13
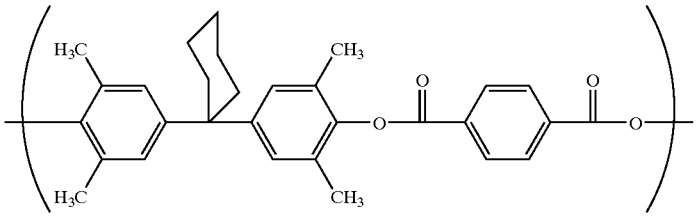
P-14
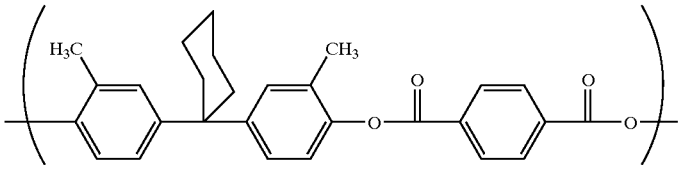

-continued
P-15
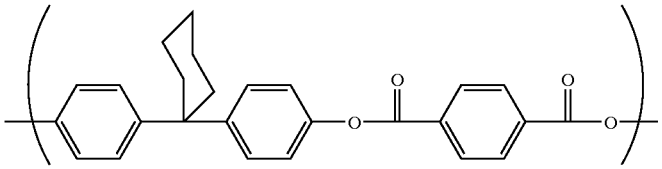
P-16
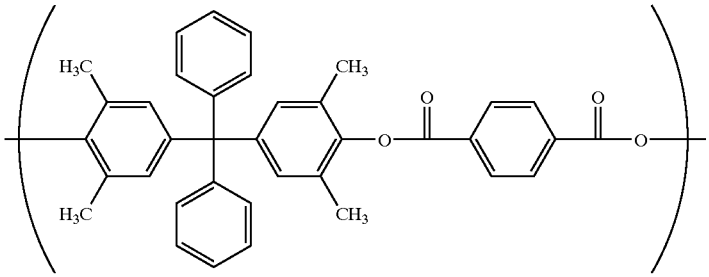
P-17
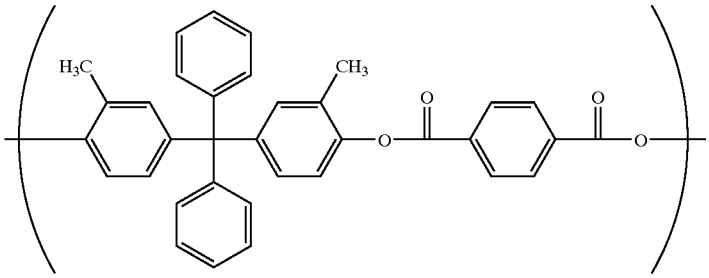
P-18
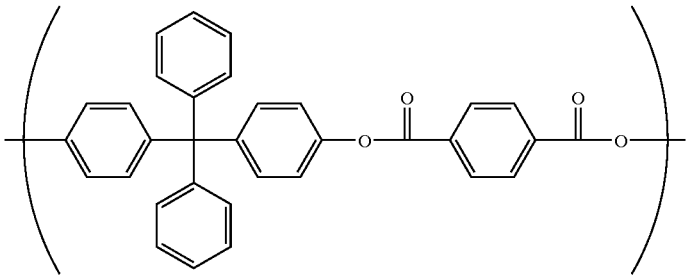
P-19
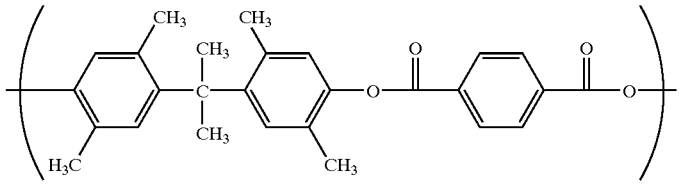
P-20
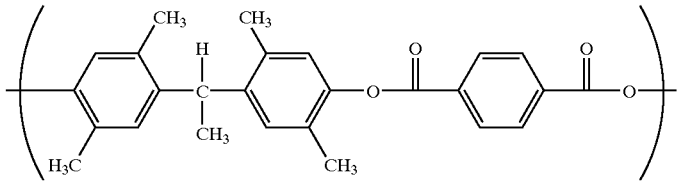
P-21
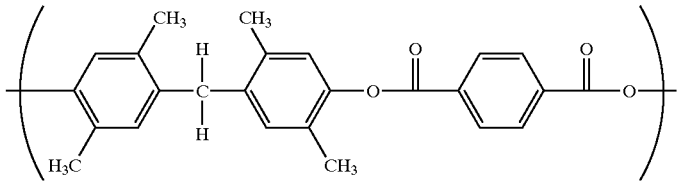

-continued
P-22
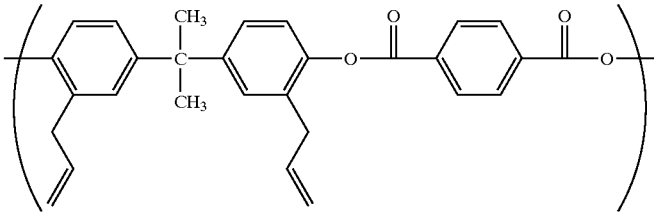
P-23
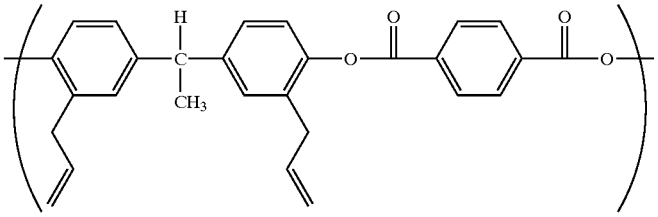
P-24
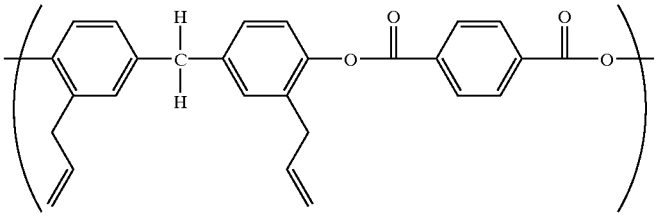
P-25
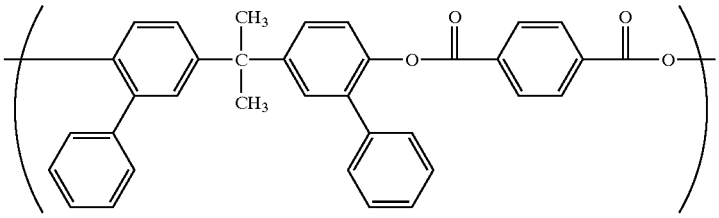
P-26
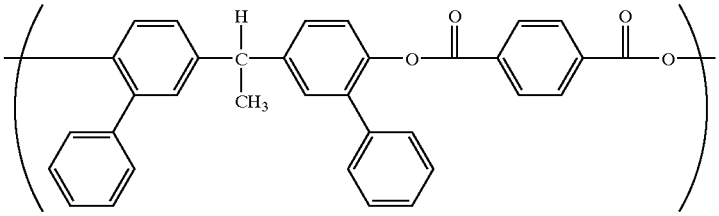
P-27
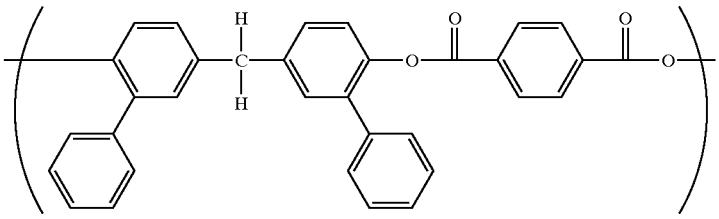
P-28
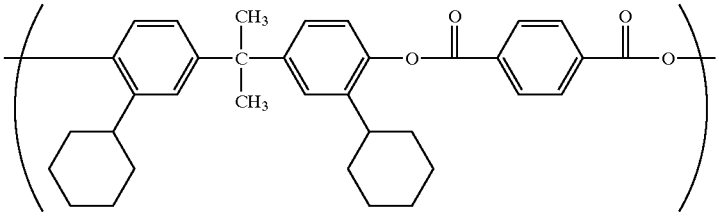

-continued
P-29
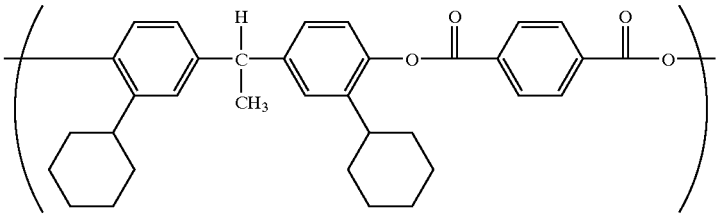
P-30
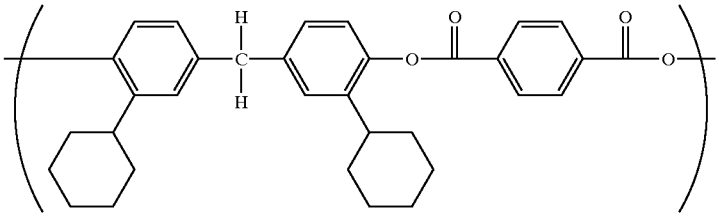
P-31
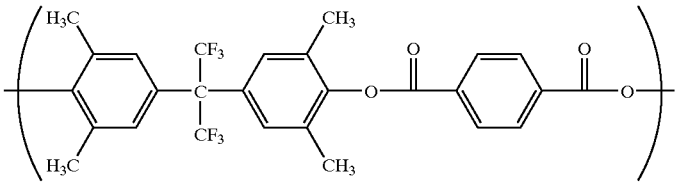
P-32
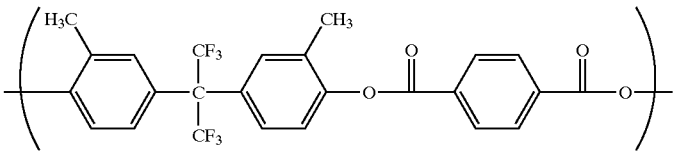
P-33
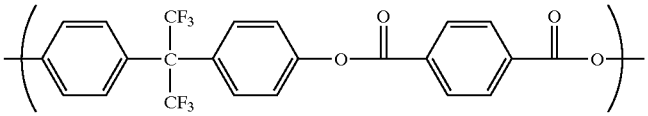
P-34
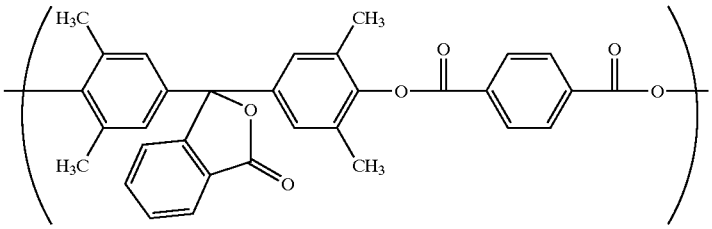
P-35
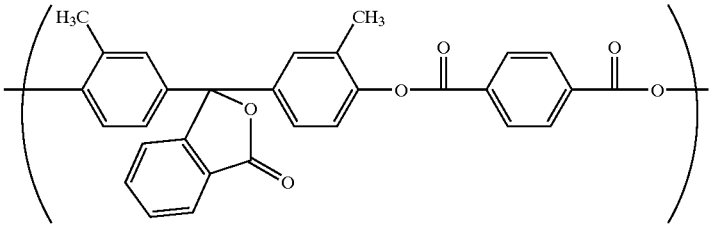

-continued
P-36
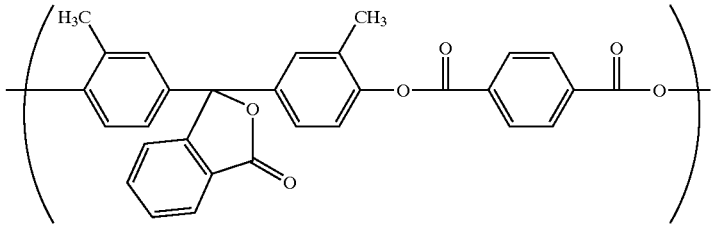
P-37
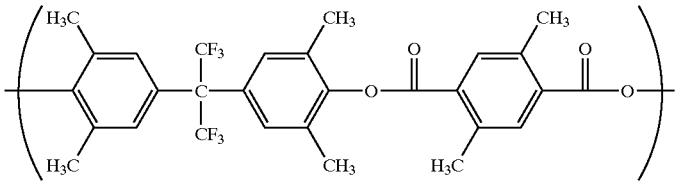
P-38
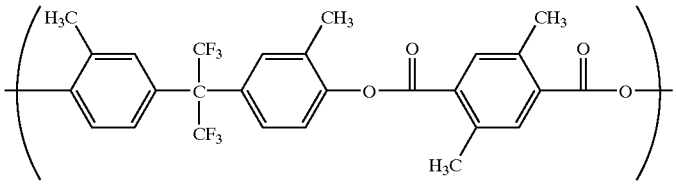
P-39
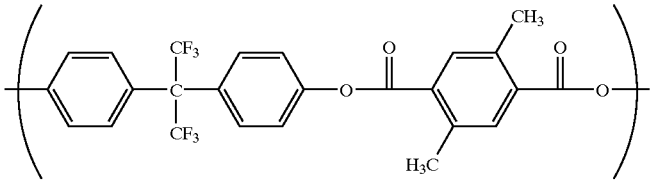
P-40
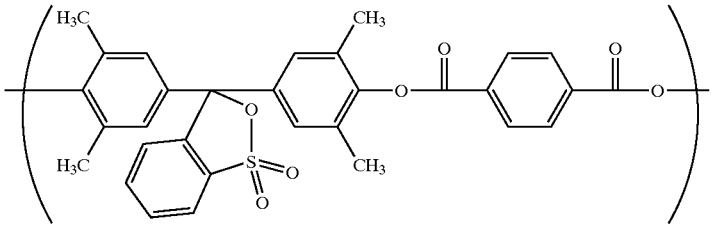
P-41
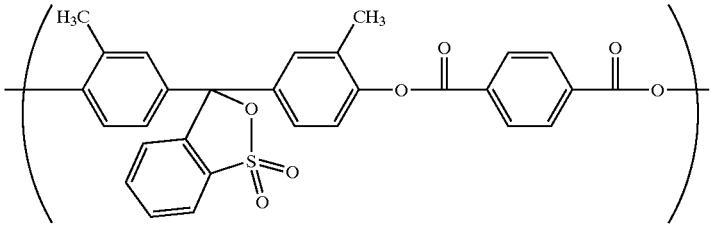
P-42
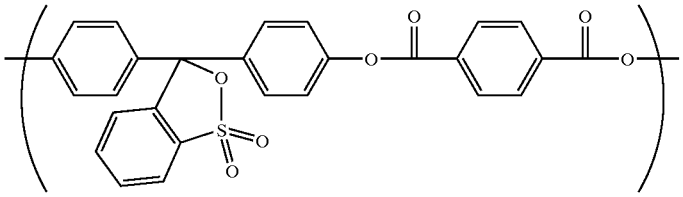

-continued
P-43
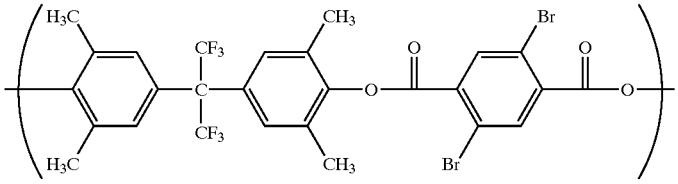
P-44
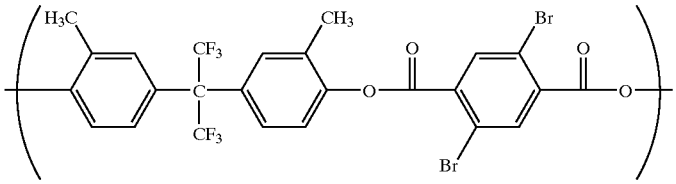
P-45
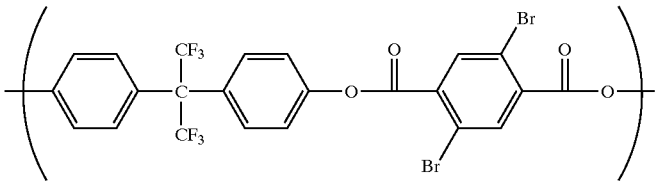
P-46
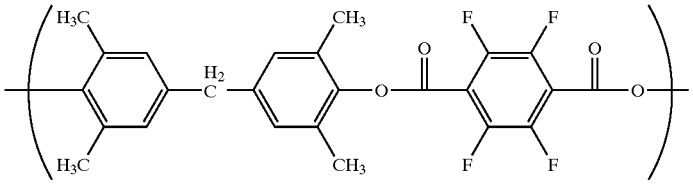
P-47
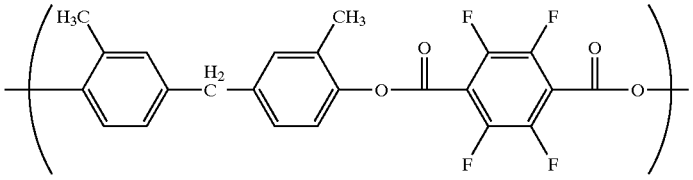
P-48
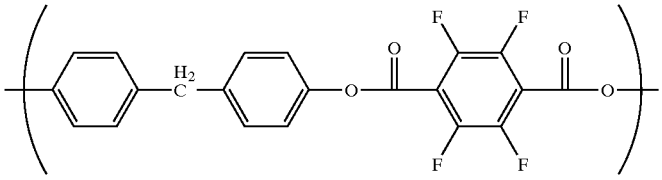
P-49
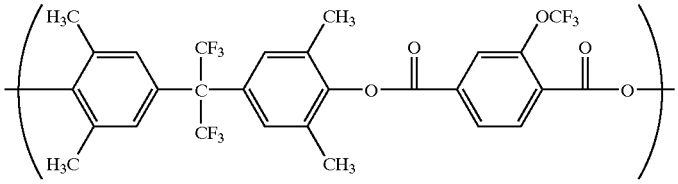
P-50
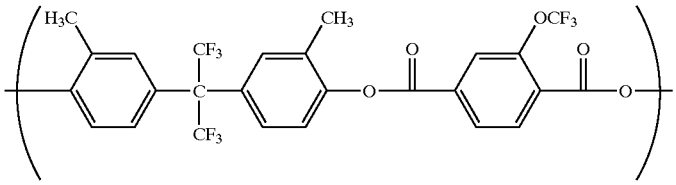

-continued
P-51
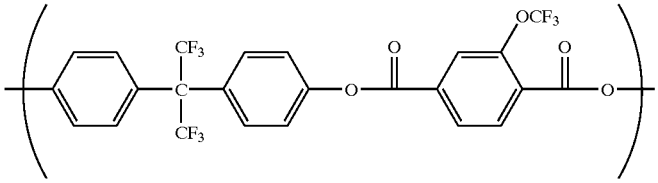
P-52
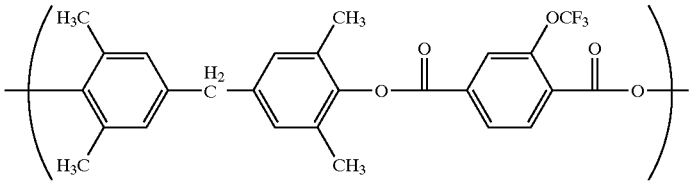
P-53
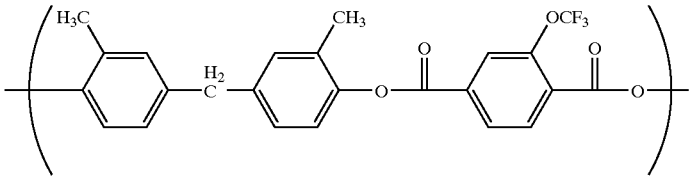
P-54
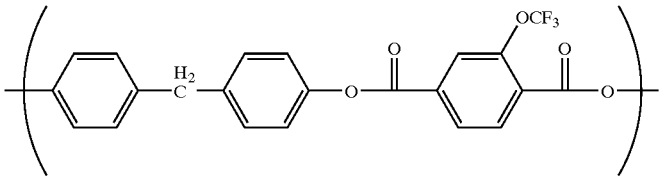
P-55
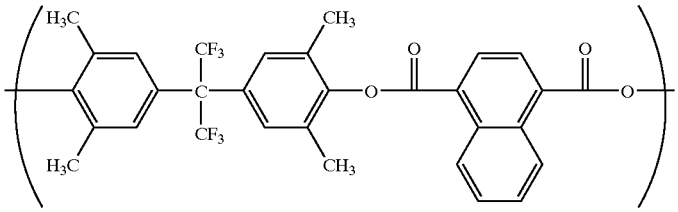
P-56
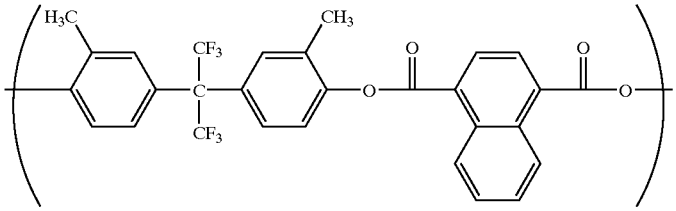
P-57
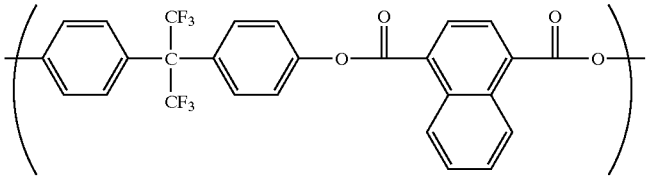
P-58
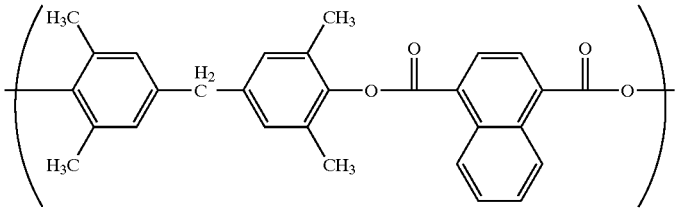

-continued
P-59
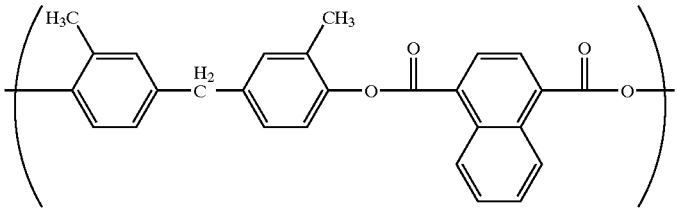
P-60
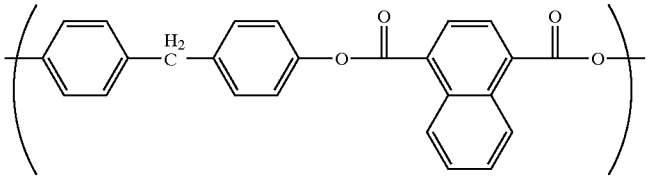
P-61
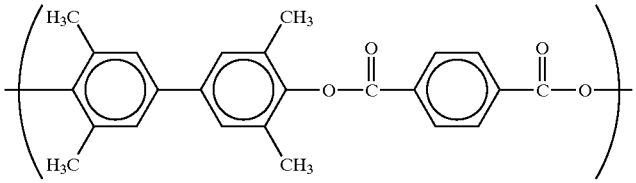
M-1
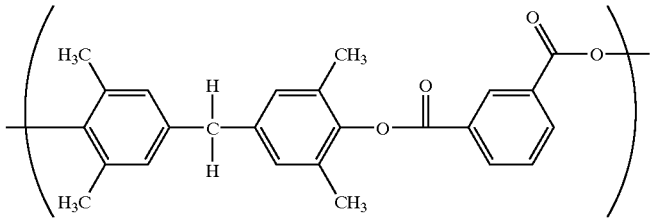
M-2
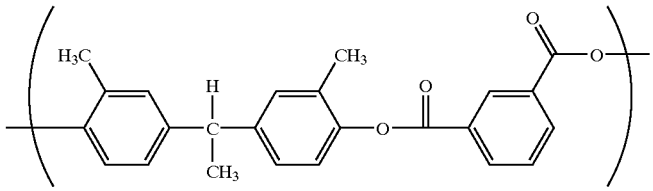
M-3
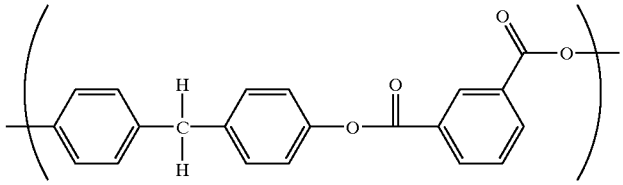
M-4
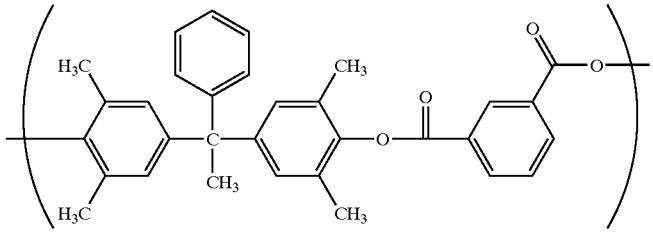

-continued
M-5
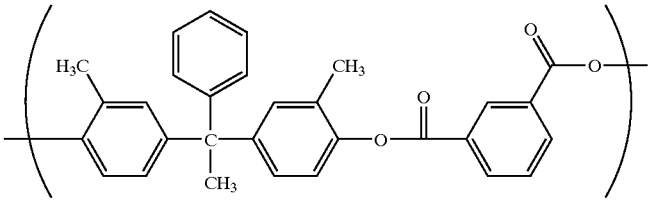
M-6
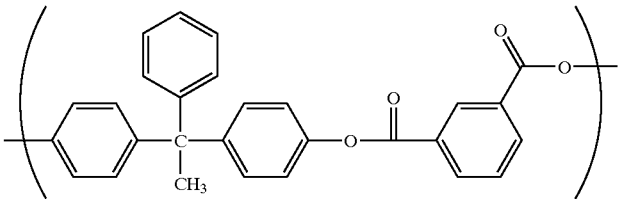
M-7
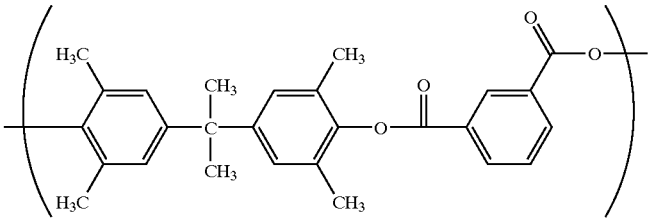
M-8
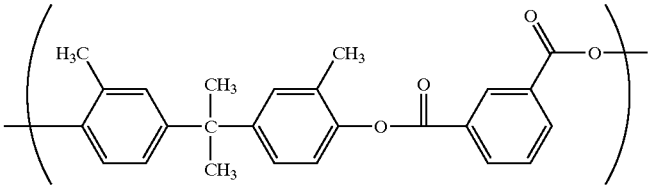
M-9
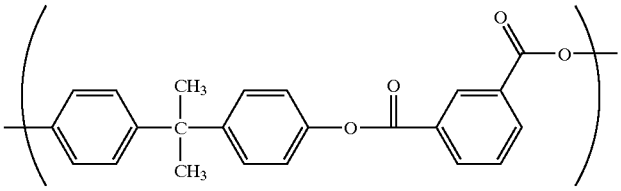
M-10
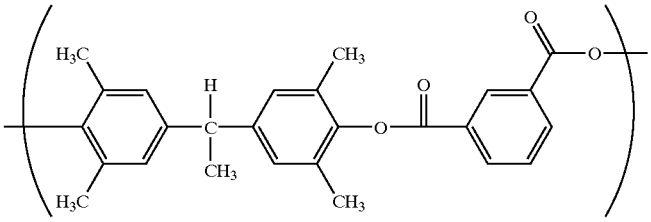
M-11
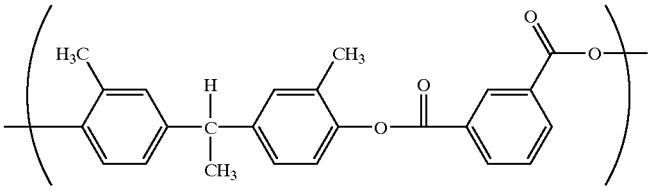

-continued
M-12
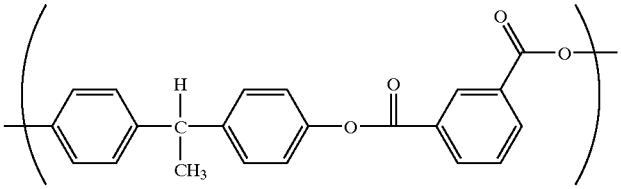
M-13
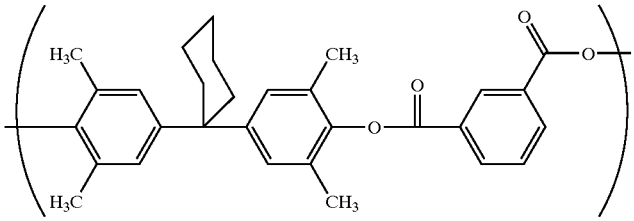
M-14
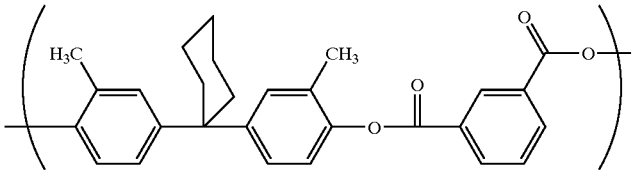
M-15
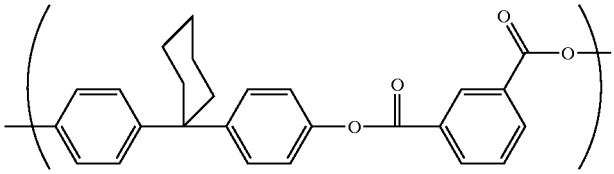
M-16
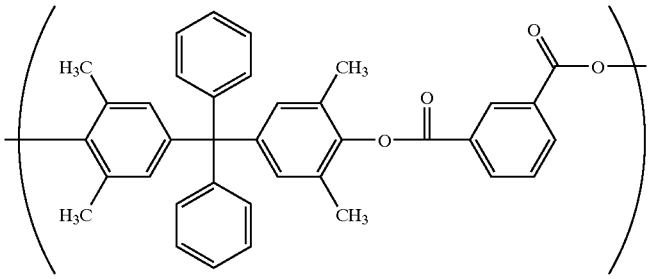
M-17
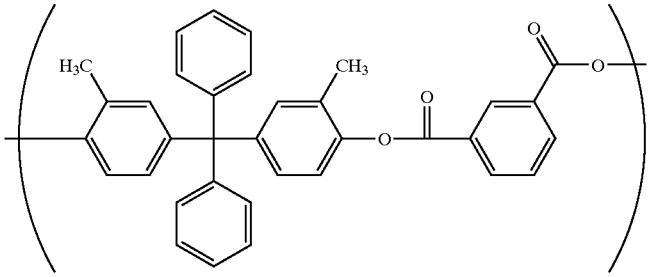

-continued
M-18
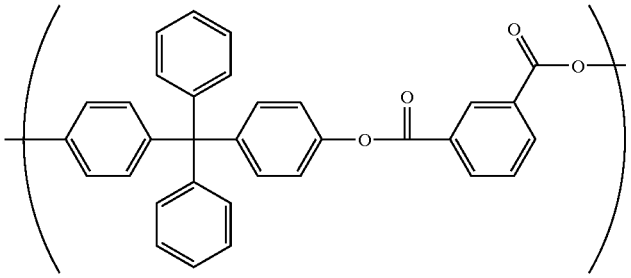
M-19
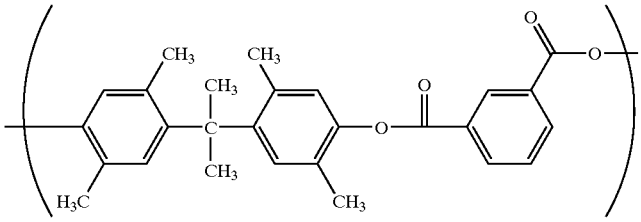
M-20
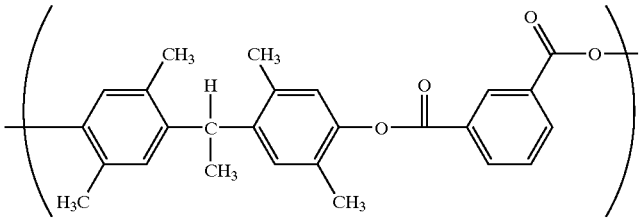
M-21
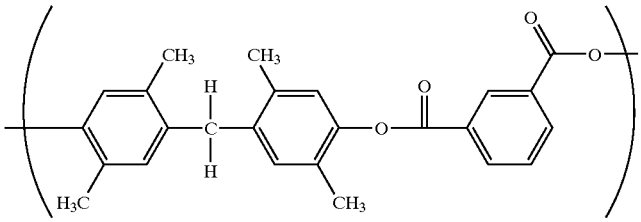
M-22
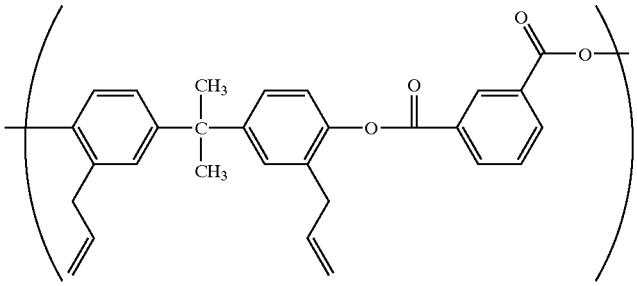
M-23
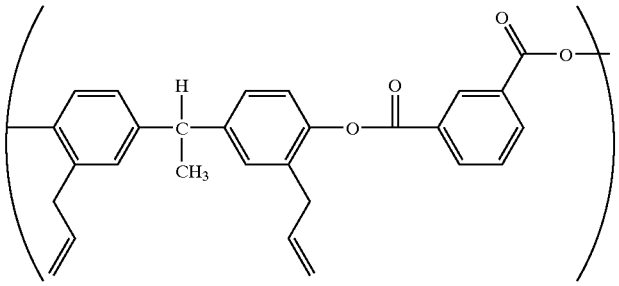

-continued
M-24
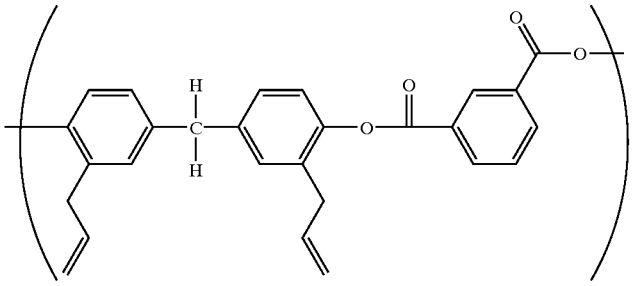
M-25
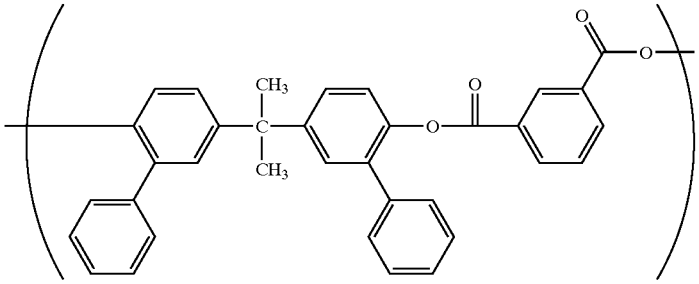
M-26
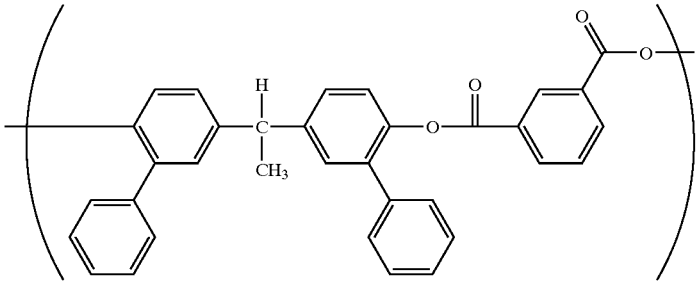
M-27
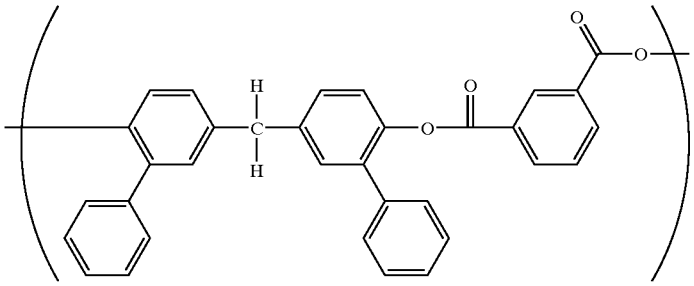
M-28
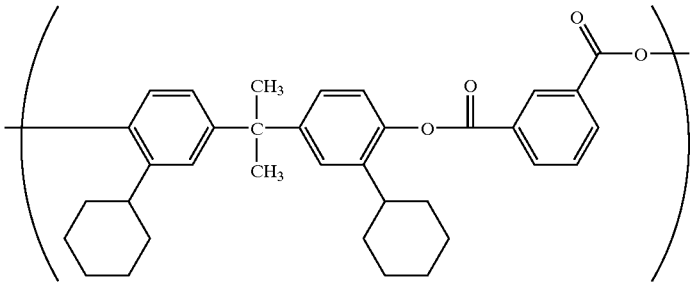

-continued
M-29
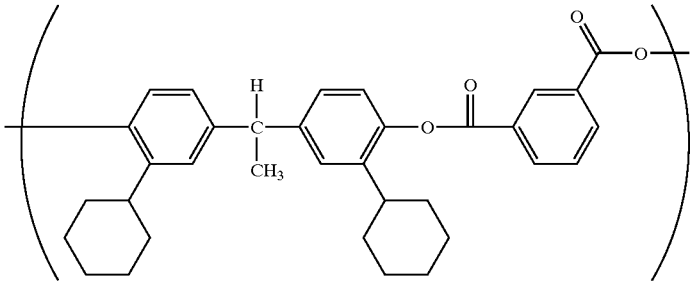
M-30
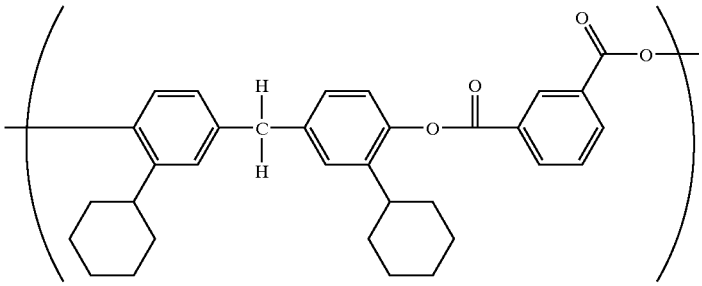
M-31
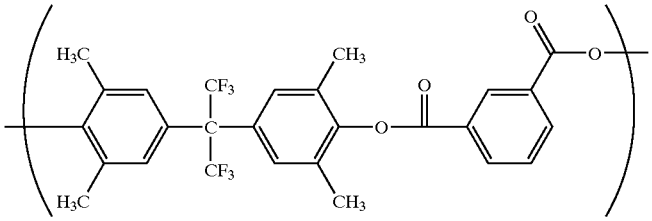
M-32
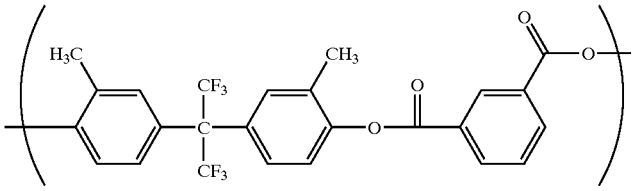
M-33
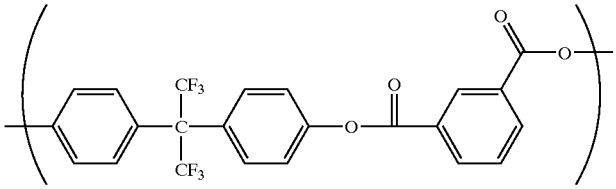
M-34
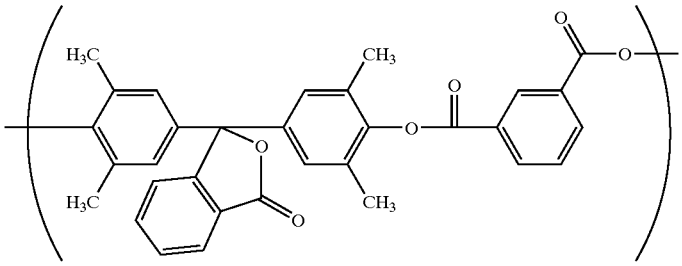

-continued
M-35
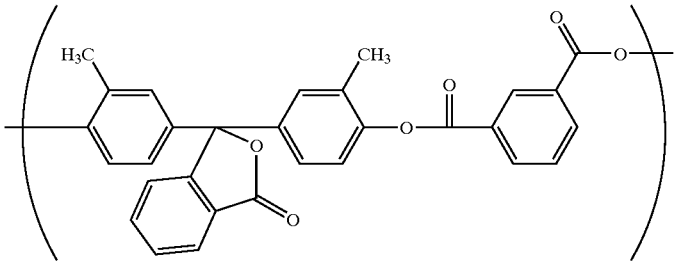
M-36
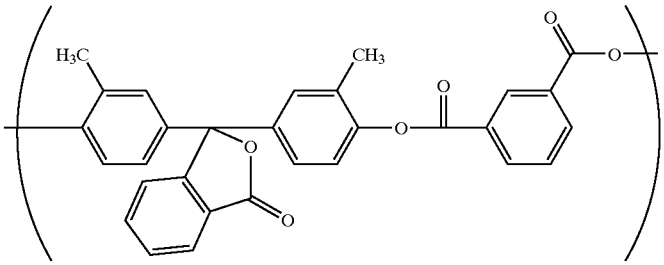
O-1
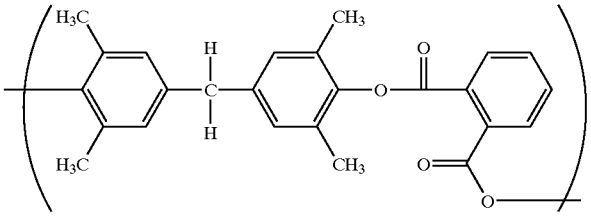
O-2
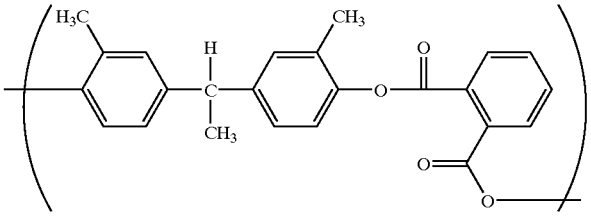
O-3
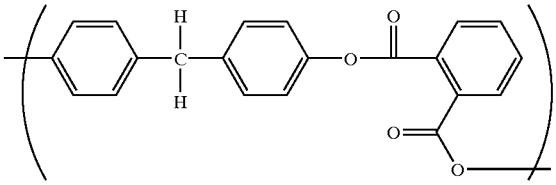
O-4
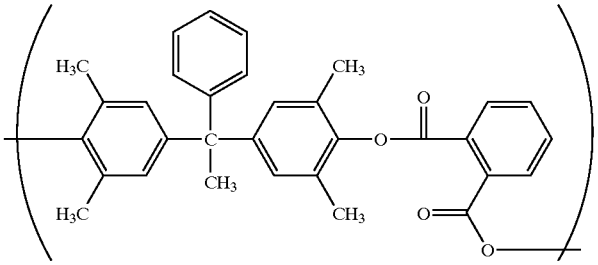

-continued

O-5

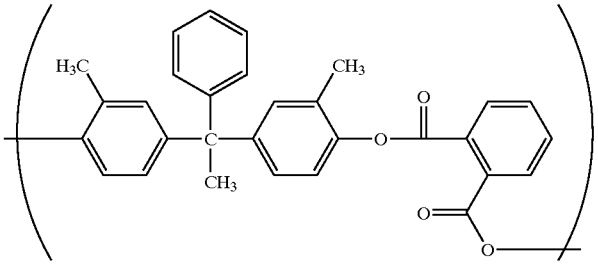

O-6

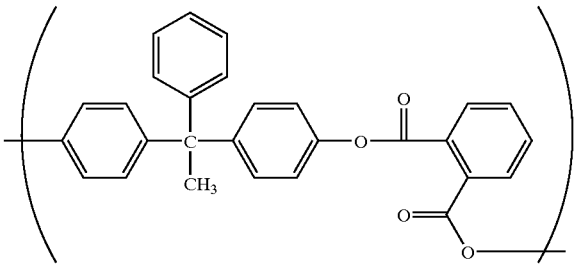

Most preferred structures are the structure including P-1 and M-1, the structure including P-1 and P-7, and the structure including P-1 and P-61.

The viscosity-average molecular weight of the resin having the polyarylate structure represented by the structure of the general formula (2) of the present invention is generally from 10,000 to 30,000, preferably from 15,000 to 100,000, and more preferably from 20,000 to 500,000. If the viscosity-average molecular weight is too small, the resin has a reduced mechanical strength, and becomes impractical. Whereas, if it is too large, the resin is difficult to coat with an appropriate film thickness.

Further, it is also possible that the resin having the polyarylate structure of the present invention is mixed with other resins for use in the electrophotographic photoreceptor. Examples of the other resins to be herein mixed therewith include thermoplastic resins and various thermosetting resins, including vinyl polymers such as polymethyl methacrylate, polystyrene, and polyvinyl chloride, and copolymers thereof, polycarbonate, polyester, polysulfone, phenoxy, epoxy, and silicone resins. Among these resins, a polycarbonate resin is preferred because when the polycarbonate resin is used in mixture with the polyarylate resin, i.e., the object of the present invention, the electric characteristics are further improved, so that the mechanical characteristics resulting from the polyarylate resin, and the electric characteristics resulting from the polycarbonate resin can be combined.

Polycarbonate resins usable may be known ones, and examples thereof include the ones having the structural units derived from, for example, the following bifunctional phenols. Examples of the bifunctional phenol compound include bis-(4-hydroxyphenyl)methane, 1,1-bis-(4-hydroxyphenyl)ethane, 1,1-bis-(4-hydroxyphenyl)propane, 2,2-bis-(4-hydroxyphenyl)propane, 2,2-bis-(4-hydroxyphenyl)butane, 2,2-bis-(4-hydroxyphenyl)pentane, 2,2-bis-(4-hydroxyphenyl)-3-methylbutane, 2,2-bis-(4-hydroxyphenyl)hexane, 2,2-bis-(4-hydroxyphenyl)-4-methylpentane, 1,1-bis-(4-hydroxyphenyl)cyclopentane, 1,1-bis-(4-hydroxyphenyl)cyclohexane, bis-(4-hydroxy-3-methylphenyl)methane, bis-(4-hydroxy-3,5-dimethylphenyl)methane, 1,1-bis-(4-hydroxy-3-methylphenyl)ethane, 2,2-bis-(4-hydroxy-3-methylphenyl)propane, 2,2-bis-(4-hydroxy-3,5-dimethylphenyl)propane, 2,2-bis-(4-hydroxy-3-ethylphenyl)propane, 2,2-bis-(4-hydroxy-3-isopropylphenyl)propane, 2,2-bis-(4-hydroxy-3-sec-butylphenyl)propane, bis-(4-hydroxyphenyl)phenylmethane, 1,1-bis-(4-hydroxyphenyl)-1-phenylethane, 1,1-bis-(4-hydroxyphenyl)-1-phenylpropane, bis-(4-hydroxyphenyl)diphenylmethane, bis-(4-hydroxyphenyl)dibenzylmethane, 4,44'-dihydroxydiphenylether, 4,4'-dihydroxydiphenylsulfone, 4,4'-dihydroxydiphenylsulfide, phenolphthalein, 5,5'-(1-methylethylidene)bis[1,1'-(biphenyl)-2-ol], [1,1'-biphenyl]-4,4'-diol, [1,1'-biphenyll-3,3'-diol, 4,4'-oxybisphenol, bis(4-hydroxyphenyl)methanone, 2,6-dihydroxynaphthalene, and 2,7-dihydroxynaphthalene. Among them, 2,2-bis-(4-hydroxyphenyl)propane is preferred in view of ease of manufacturing, and 1,1-bis-(4-hydroxyphenyl)cyclopentane, 1,1-bis-(4-hydroxyphenyl)cyclohexane, 2,2-bis-(4-hydroxy-3-methylphenyl)propane, and 1,1-bis-(4-hydroxyphenyl)-1-phenylethane are particularly preferred in view of the mechanical properties. These structural units may be polymerized singly, or copolymerized in combination of two or more thereof. Further, the polycarbonate resins may be used singly, or used in mixture of two or more thereof.

The amount of other resins which may be used in mixture with the polyarylate resins is generally 50% by weight or less, preferably 30% by weight or less, and most preferably 10% by weight or less based on the total amount of the binder resin to be used in the photosensitive layer (based on the total amount of the binder resin to be used in the charge transport layer for the lamination type photoreceptor described later).

(2-2) Method for Manufacturing a Polyarylate Resin

The polyarylate resin to be used in the present invention can be manufactured by a known polymerization method, examples of which include an interfacial polymerization method, a melt polymerization method, and a solution polymerization method.

For example, in the case of manufacturing by the interfacial polymerization method, a solution of a bifunctional phenol component or a bisphenol component dissolved in an alkaline aqueous solution and a solution of an aromatic dicarboxylic acid chloride component dissolved in a halogenated hydrocarbon are mixed.

Specific examples of the bifunctional phenol component or bisphenol component include hydroquinone, resorcinol, 1,3-dihydroxynaphthalene, 1,4-dihydroxynaphthalene, 2,3-dihydroxynaphthalene, 2,6-dihydroxynaphthalene, 2,7-dihydroxynaphthalene, 1,8-dihydroxynaphthalene, 1,5-dihydroxynaphthalene, bis-(4-hydroxyphenyl)methane, bis-(2-hydroxyphenyl)methane, (2-hydroxyphenyl)(4-hydroxyphenyl)methane, 1,1-bis-(4-hydroxyphenyl)ethane, 1,1-bis-(4-hydroxyphenyl)propane, 2,2-bis-(4-hydroxyphenyl)propane, 2,2-bis-(4-hydroxyphenyl)butane, 2,2-bis-(4-hydroxyphenyl)pentane, 2,2-bis-(4-hydroxyphenyl)-3-methylbutane, 2,2-bis-(4-hydroxyphenyl)hexane, 2,2-bis-(4-hydroxyphenyl)-4-methylpenetane, 1,1-bis-(4-hydroxyphenyl)cylcopentane, 1,1-bis-(4-hydroxyphenyl)cyclohexane, bis-(3-phenyl-4-hydroxyphenyl)methane, 1,1-bis-(3-phenyl-4-hydroxyphenyl)ethane, 1,1-bis-(3-phenyl-4-hydroxyphenyl)propane, 2,2-bis-(3-phenyl-4-hydroxyphenyl)propane, bis-(4-hydroxy-3-methylphenyl)methane, 1,1-bis-(4-hydroxy-3-methylphenyl)ethane, 2,2-bis-(4-hydroxy-3-methylphenyl)propane, 2,2-bis-(4-hydroxy-3-ethylphenyl)propane, 2,2-bis-(4-hydroxy-3-isopropylphenyl)propane, 2,2-bis-(4-hydroxy-3-sec-butylphenyl)propane, bis-(4-hydroxy-3,5-dimethylphenyl)methane, 1,1-bis-(4-hydroxy-3,5-dimethylphenyl)ethane, 2,2-bis-(4-hydroxy-3,5-dimethylphenyl)propane, bis-(4-hydroxy-3,6-dimethylphenyl)methane, 1,1-bis-(4-hydroxy-3,6-dimethylphenyl)ethane, bis-(4-hydroxyphenyl)phenylmethane, 1,1-bis-(4-hydroxyphenyl)-1-phenylethane, 1,1-bis-(4-hydroxyphenyl)-1-phenylpropane, bis-(4-hydroxyphenyl)diphenylmethane, bis-(4-hydroxyphenyl)dibenzylmethane, 4,4'-dihydroxydiphenylether, 4,4'-dihydroxydiphenylsulfone, 4,4'-dihydroxydiphenylsulfide, phenolphthalein, 4,4'-[1,4-phenylenebis(1-methylvinylidene)]bisphenol, and 4,4'-[1,4-phenylenebis(1-methylvinylidene)]bis[2-methylphe nol].

Among them, the bisphenol components such as bis-(4-hydroxyphenyl)methane, 1,1-bis-(4-hydroxyphenyl)ethane, 2,2-bis-(4-hydroxyphenyl)propane, 2,2-bis-(3-phenyl-4-hydroxyphenyl)propane, bis-(4-hydroxy-3-methylphenyl)methane, 1,1-bis-(4-hydroxyphenyl)cyclohexane, 1,1-bis-(4-hydroxy-3-methylphenyl)ethane, 2,2-bis-(4-hydroxy-3-methylphenyl)propane, bis-(4-hydroxy-3,5-dimethylphenyl)methane, 1,1-bis-(4-hydroxy-3,5-dimethylphenyl)ethane, 2,2-bis-(4-hydroxy-3,5-dimethylphenyl)propane, bis-(4-hydroxy-3,6-dimethylphenyl)methane, and 1,1-bis-(4-hydroxyphenyl)-1-phenylethane are preferred.

In this step, it is also possible that a quaternary ammonium salt or a quaternary phosphonium salt is present as a catalyst. It is preferable in view of the productivity that the polymerization temperature is generally in the range of from 0° to 40° C., and that the polymerization time is in the range of from 2 to 12 hours. After the completion of polymerization, the water phase and the organic phase are separated from each other to wash and recover the polymer dissolved in the organic phase with a known method. Consequently, an objective resin can be obtained.

Examples of the alkaline component to be herein used include hydroxides of alkaline metals such as sodium hydroxide and potassium hydroxide. The amount of the alkali to be used is preferably in the range of from 1.01- to 3-fold equivalent of the phenolic hydroxyl group contained in the reaction system.

Further, examples of the halogenated hydrocarbon to be herein used include dichloromethane, chloroform, 1,2-dichloroethane, trichloroethane, tetrachloroethane, and dichlorobenzene.

Examples of the quaternary ammonium salt or the quaternary phosphonium salt to be used as a catalyst include salts of hydrochloric acid, bromic acid, iodic acid, or the like, of tertiary alkylamine such as tributylamine or trioctylamine, benzyltriethylammonium chloride, benzyltrimethylammonium chloride, benzyltributylammonium chloride, tetraethylammonium chloride, tetrabutylammonium chloride, tetrabutylammonium bromide, trioctylmethylammonium chloride, tetrabutylphosphonium bromide, triethyloctadecylphosphonium bromide, N-laurylpyridinium chloride, and laurylpicolinium chloride.

As the aromatic dicarboxylic acid chloride component, isophthalic acid chloride and terephthalic acid chloride are preferably used in a specific ratio.

Specific examples of the bifunctional phenol component or bisphenol component are as described above, and the above-described compounds can be used singly, or in mixture of two or more thereof.

Examples of the molecular weight modifier which may be present during the polymerization include phenol, alkylphenols such as o-, m-, or p-cresol, o-, m-, or p-ethylphenol, o, m, p-propylphenol, o-, m-, or p-tert-butylphenol, pentylphenol, hexylphenol, octylphenol, and nonylphenol, 2,6-dimethylphenols such as 2,6-dimethylphenol, 2,4,6-trimethylphenol, and 2,6-dimethyl-4-alkylphenol, monofunctional phenols such as o-, m-, or p-phenylphenols, and monofunctional acid halides such as acetic acid chloride, butyric acid chloride, octylic acid chloride, benzoyl chloride, benzenesulfonyl chloride, benzenesulfinyl chloride, sulfinyl chloride, and benzenephosphonyl chloride, and substitution products thereof.

(3) Charge Transport Material

In the present invention, from the state of the molecular orbital of the charge transport material in the polyarylate resin, it is important that the charge polarizability $\alpha$ of the charge transport material to be used satisfies the following formula:

$$\alpha > 100\ (\text{Å}^3)$$

Further, it is preferable that $$\alpha > 115\ (\text{Å}^3)$$

Further, it is preferable for ensuring use thereof in a low number of parts that $\alpha > 120$ (Å$^3$)

Further, when the state of the field in the polyarylate resin is considered, the dipole moment of the charge transport material is preferably $P < 1.60$ (D)

and, more preferably $P < 1.55$ (D)

and it is preferable for ensuring use thereof at low temperatures that $P < 1.50$ (D)

Further, as the values of the polarizability and the dipole moment, the calculated values by a molecular orbital method may also be used in place of the measured values.

When the calculated value by a structure-optimization calculation using a PM3 or AM1 parameter of MOPAC93 is used as the specific value, the calculated value $\alpha cal$ of the polarizability $\alpha$ satisfies the following formula:

$\alpha cal > 70$ (Å$^3$), preferably the following formula:

$\alpha cal > 80$ (Å$^3$), and more preferably the following formula:

$\alpha cal > 90$ (Å$^3$)

Further, the calculated value Pcal of the dipole moment, using the same calculation method as described above satisfies the following formula:

$Pcal < 1.8$ (D), preferably the following formula:

$Pcal < 1.6$ (D), and, in considering the use thereof at low temperatures, more preferably the following formula:

$Pcal < 1.5$ (D)

Examples of the charge transport material include electron-withdrawing substances including aromatic nitro compounds such as 2,4,7-trinitrofluorenone, cyano compounds such as tetracyanoquinodimethane, and quinones such as diphenoquinone, and electron donating substances including heterocyclic compounds such as carbazole derivatives, indole derivatives, imidazole derivatives, oxazole derivatives, pyrazole derivatives, oxadiazole derivatives, pyrazoline derivatives, and thiadiazole derivatives, aniline derivatives, hydrazone compounds, aromatic amine derivatives, stilbene derivatives, butadiene derivatives and enamine compounds, and the ones obtained by combining a plurality of the compounds, or polymers having a group comprising these compounds at its main chain or side chain. Among them, carbazole derivatives, hydrazone derivatives, aromatic amine derivatives, stilbene derivatives, and butadiene derivatives, and the ones obtained by combining a plurality of the derivatives are preferred, and the ones obtained by combining a plurality of aromatic amine derivatives, stilbene derivatives, and butadiene derivatives, are particularly preferred.

As the components, there may be mentioned the following general formula (1):

(1)

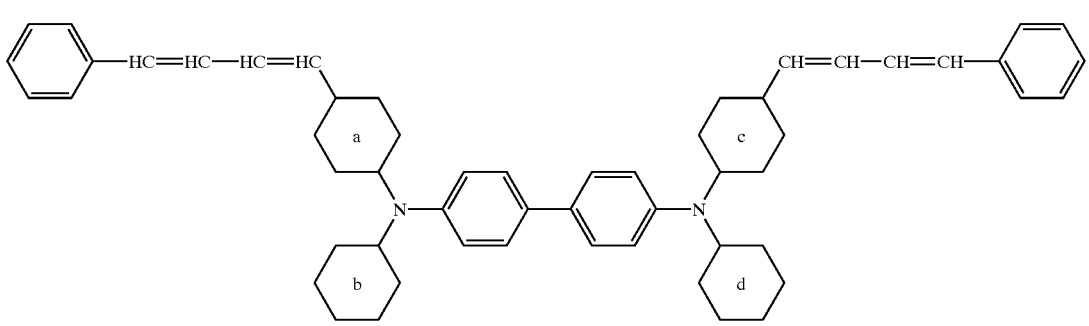

In the general formula (1), the rings a, b, c and d each represent a benzene ring which may have 1 to 4 substituents. Examples of the substituents include, each independently, any of a hydrogen atom, an alkyl group having 1 to 6 carbon atoms, an alkoxyl group having 1 to 4 carbon atoms, a halogen atom, a halogenated alkyl group, an aromatic group having 6 to 20 carbon atoms which may have a substituent.

Examples of the alkyl group having 1 to 6 carbon atoms include methyl, ethyl, n-propyl, isopropyl, n-butyl, isobutyl, sec-butyl, tert-butyl, n-pentyl, sec-pentyl, and n-hexyl groups. Examples of the alkoxy group having 1 to 4 carbon atoms include methoxy, ethoxy, n-propoxy, and n-butoxy groups. Further, examples of halogen include chlorine, bromine, and fluorine atoms, and examples of the halogenated alkyl group include chloromethyl, dichloromethyl, trichloromethyl, and trifluoromethyl groups. Examples of the aromatic group which may have a substituent include phenyl, 4-methylphenyl, and naphthyl groups. Among them, as the substituent of the rings a, b, c and d, the hydrogen atom and methyl groups are preferably used, and in particular, the methyl group is preferably used.

Specifically, the following ones are preferably used, and the compound No. 1 is particularly preferred.

1
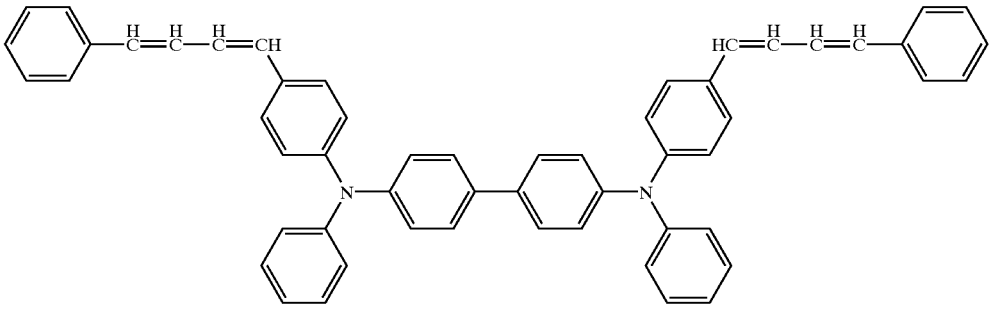
2
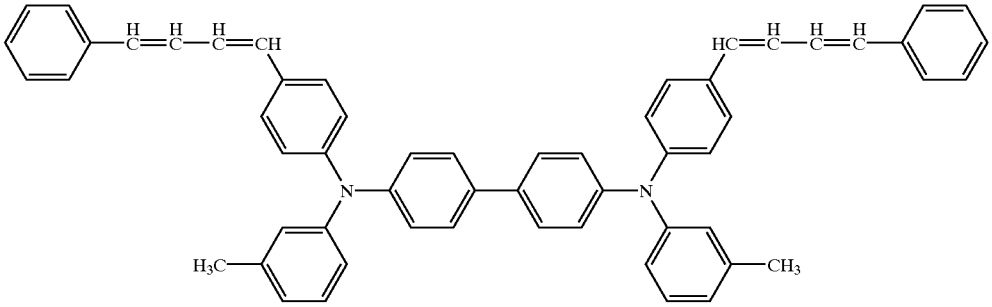
3
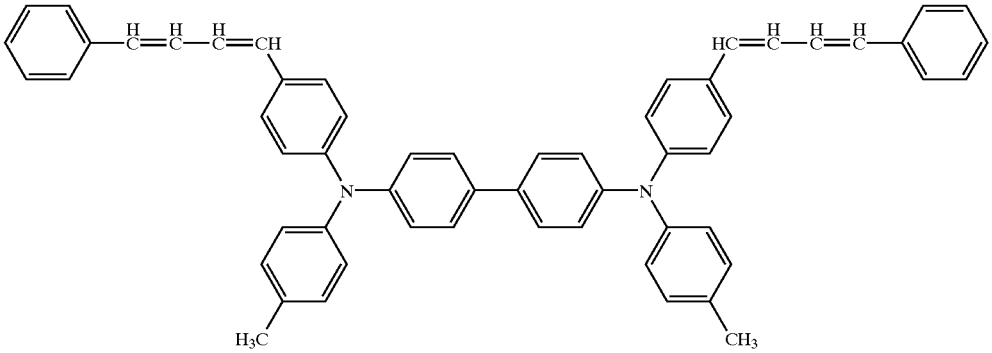
4
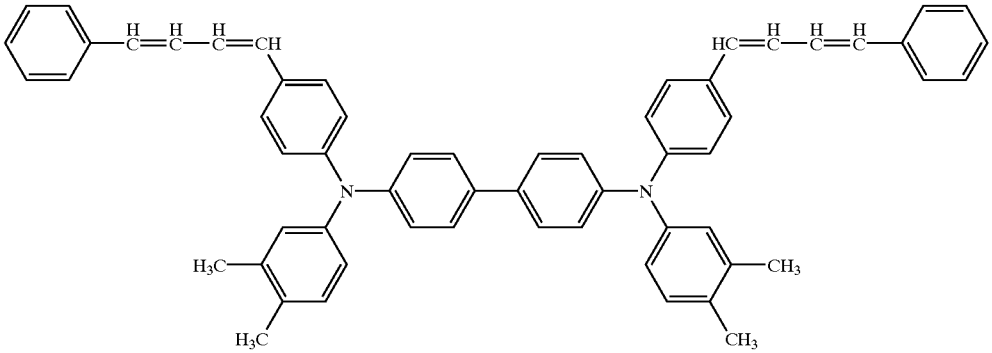

-continued
5
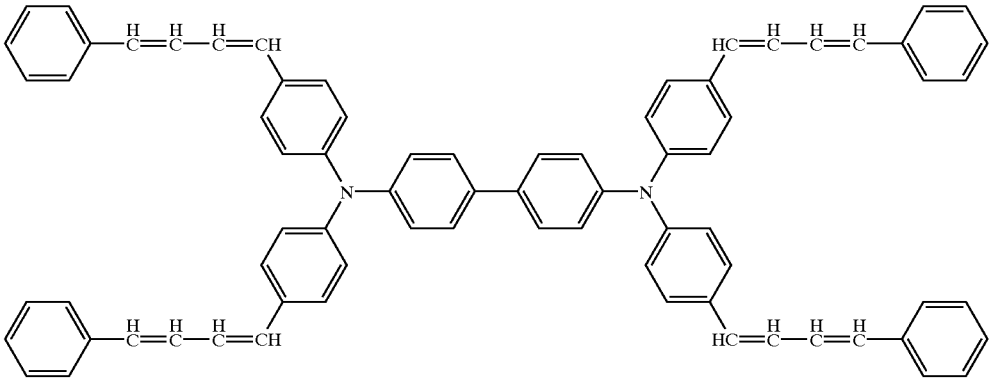
6
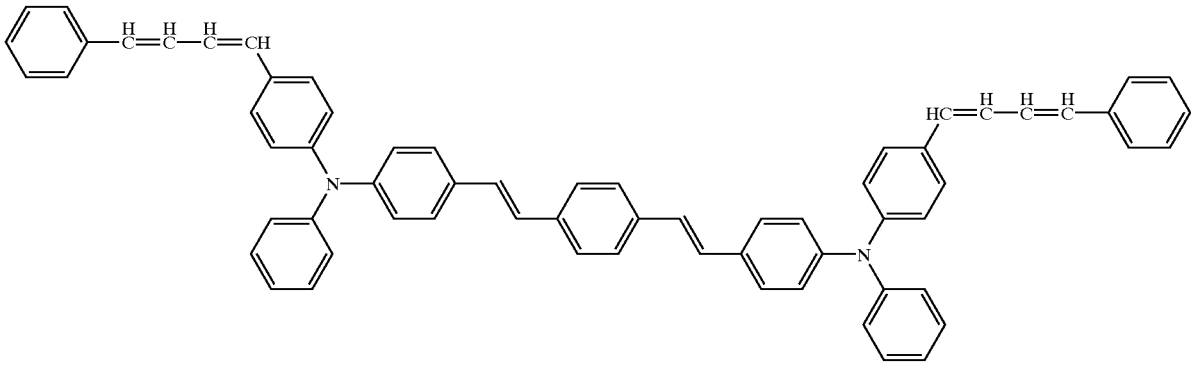
7
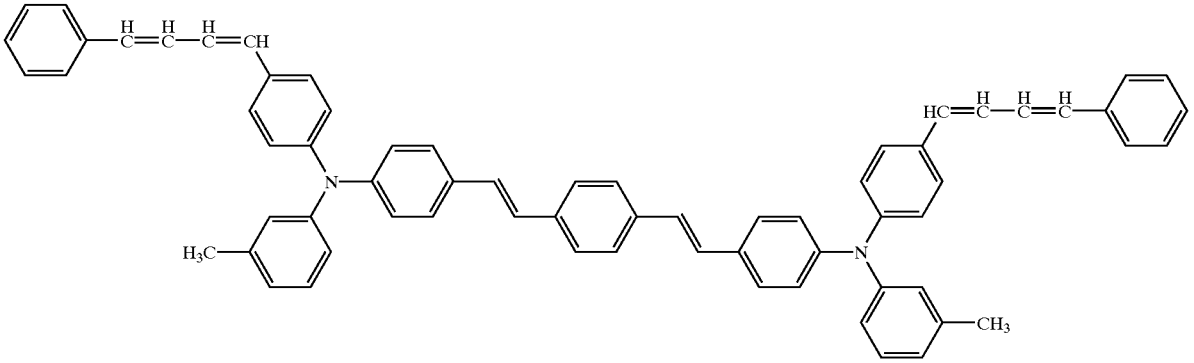
8
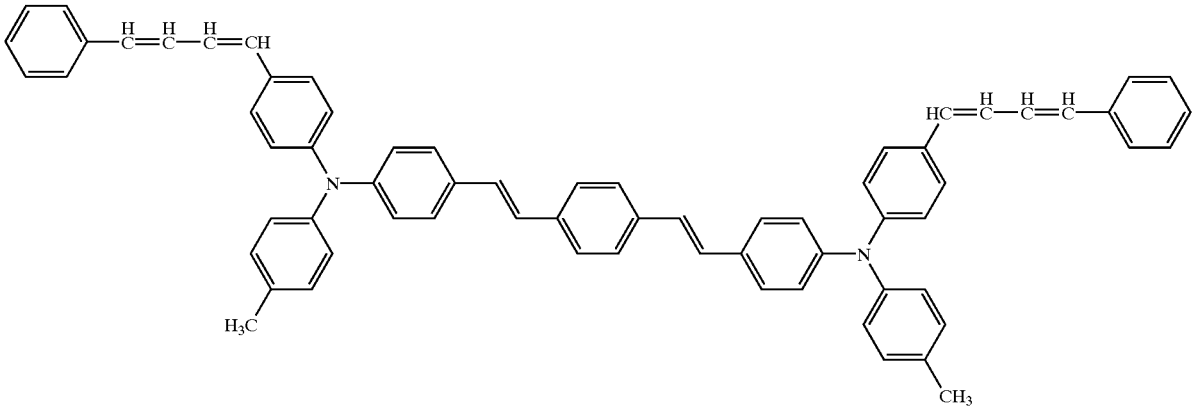

These charge transport materials may be used singly, or in mixture of some of them. The charge transport layer is formed in such a configuration that the charge transport materials are bound to a binder resin. The charge transport layer may be comprised of a single layer, or a plurality of stacked layers mutually different in the constituents or composition ratio.

It is desirable that the content of the charge transport material in the photosensitive layer or the charge transport layer is 45% by weight or less, preferably 40% by weight or less, more preferably 35% by weight or less, andmost preferably 30% by weight or less in view of the printing durability.

(4) Lamination-Type Photosensitive Layer (4-1) Charge Generation Layer

In the case of the lamination-type photoreceptor, examples of the charge generation material to be used for the charge generation layer include selenium and alloys thereof, cadmium sulfide, and other inorganic photoconductive materials, and various photoconductive materials including organic pigments such as phthalocyanine pigments, azo pigments, quinacridone pigments, indigo pigments, perylene pigments, polycyclic quinone pigments, anthanthrone pigments, and benzimidazole pigments. The organic pigments are particularly preferred, and phthalocyanine pigments and azo pigments are more preferred.

Among them, metal-free phthalocyanine, phthalocyanines in which metals such as copper, indium, gallium, tin, titanium, zinc, and vanadium, or oxides or chlorides thereof are coordinated, and azo pigments such as monoazos, bisazos, trisazos, and polyazos are preferred.

As the azo components of the preferred azo pigments, there may be mentioned the following structures:

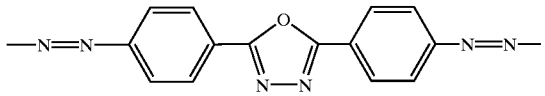

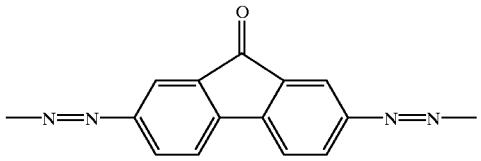

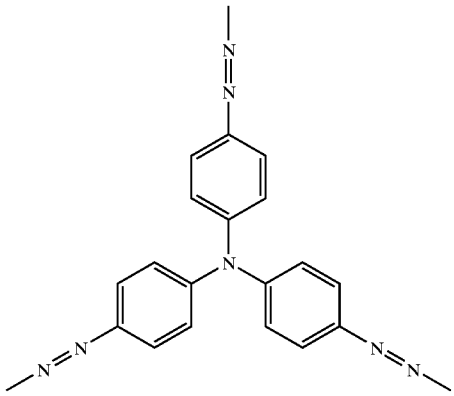

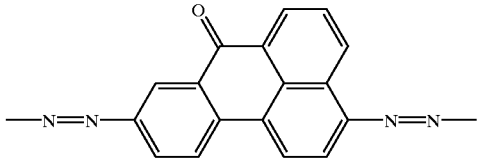

As the preferred couplers, there may be mentioned the following structures:

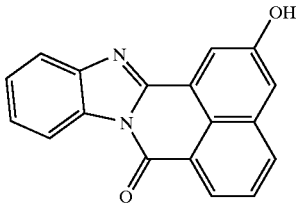

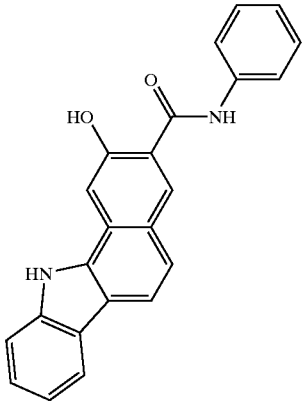

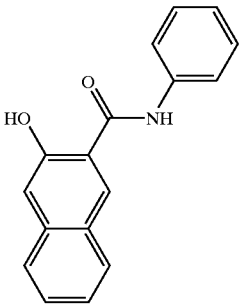

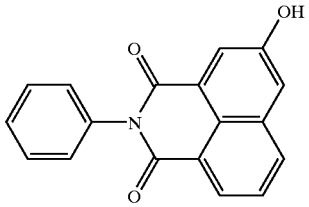

These azo components and couplers may have substituents.

When a phthalocyanine compound is used as the charge generation material, specifically, metal-free phthalocyanine and phthalocyanines in which metals such as copper, indium, gallium, tin, titanium, zinc, vanadium, silicon, and germanium, or oxides thereof, halides thereof, or the like are coordinated are used. Examples of the ligand to a trivalent or more metal atom include a hydroxyl group and an alkoxy group in addition to the foregoing oxygen atom and chlorine atom. In particular, high-sensitivity X-form, and τ-form metal-free phthalocyanines, α-form, β-form, Y-form, or the like of titanyl phthalocyanine, vanadyl phthalocyanine, chloroindium phthalocyanine, chlorogallium phthalocyanine, hydroxygallium phthalocyanine, and the like are preferred. Incidentally, out of the crystal forms of titanyl phthalocyanine herein cited, the α-, and β-forms are referred to as II-, and I-phases, respectively by W. Hellers, et al., (Zeit. Kristallogr. 159 (1982) 173), and the β-form is known as the stable form. The most preferably used Y-form is the crystal form characterized in that a distinct peak is shown at a diffraction angle 2θ±0.20 of 27.3° in a powder X-ray diffraction using a CuK α ray. The phthalocyanine compounds may be used singly, or in mixture of some thereof. The phthalocyanine compounds herein used or the ones in crystal form in a mixed state may be obtained by mixing respective constituents afterwards, or by causing the mixed state in the manufacturing and treatment process of the phthalocyanine compound, such as synthesis, formation into pigment, crystallization, or the like. As such treatment, an acidpaste treatment, a grinding treatment, a solvent treatment, or the like is known.

These charge generation materials are bound by various binder resins such as polyester resin, polyvinyl acetate, polyacrylic acid ester, polymethacrylic acid ester, polycarbonate, polyvinyl acetoacetal, polyvinyl propional, polyvinyl butyral, phenoxy resin, epoxy resin, urethane resin, cellulose ester, and cellulose ether to be used. The amount of the charge generation material to be used in this case is in the range of, generally from 20 to 2000 parts by weight, preferably from 30 to 500 parts by weight, and more preferably from 33 to 500 parts by weight per 100 parts by weight of the binder resin.

Further, if required, the charge generation material may contain other organic photoconductive compounds, dye coloring matters, and electron withdrawing compounds.

The film thickness of the charge generation layer is generally from 0.05 to 5 μm, preferably 0.1 to 2 μm, and more preferably 0.15 to 0.8 μm.

(4-2) Charge Transport Layer

As the charge transport material and the polyarylate resin to be used as the binder resin, the foregoing ones are used.

As for the ratio of the binder resin to the charge transport material, in general, the charge transport material is used in an amount of, generally from 30 to 200 parts by weight, preferably from 40 to 150 parts by weight or less, and most preferably an upper limit of 90 parts by weight or less per 100 parts by weight of the binder resin for advantageously maintaining the mechanical characteristics of the polyarylate. Further, the film thickness is generally from 10 to 60 μm, preferably from 10 to 45 μm, and more preferably from 27 to 40 μm.

The charge transport layer may contain additives such as known plasticizers, antioxidants, ultraviolet absorbers, electron-withdrawing compounds, leveling agents, and sensitizer for improving the film-forming properties, flexibility, coating property, stain resistance, gas resistance, light fastness, and the like.

Examples of the antioxidant include a hindered phenol compound and a hindered amine compound.

(5) Monolayer Type Photosensitive Layer

In the case of the monolayer type photosensitive layer, the same charge generation material as in the lamination type photoreceptor and the foregoing charge transport material are dispersed in the charge transport medium mainly comprised of the foregoing polyarylate resin.

The particle size of the charge generation material to be used in such a case is required to be sufficiently small, and it is preferably 1 μm or less, and more preferably 0.5 μm or less. If the amount of the charge generation material to be dispersed in the photosensitive layer is too small, sufficient sensitivity cannot be obtained. Whereas, if it is too much, there occur detrimental effects such as a reduction in the triboelectricity, a reduction in the sensitivity, and the like. Accordingly, the charge generation material is used, for example, preferably in the range of from 0.5 to 50% by weight, and more preferably in the range of from 1 to 20% by weight.

The film thickness of the photosensitive layer to be used is generally from 5 to 50 μm, and preferably from 10 to 45 μm. It is also acceptable in this case that there are added therein known plasticizers for improving the film-forming properties, flexibility, mechanical strength, and the like, additives for controlling the residual potential, dispersant aids for improving the dispersion stability, leveling agents for improving the coating properties, surfactants, for example, a silicone oil, a fluorine-based oil, and other additives.

(6) Other Additives

Examples of the dye coloring matter to be optionally added to the photosensitive layer include triphenylmethane dyes such as methyl violet, brilliant green, and crystal violet, thiazine dyes such as methylene blue, quinone dyes such as quinizarin, and a cyanine dye, and pyrylium salts, thiapyrylium salts, and benzopyrylium salts.

Further, examples of the electron-withdrawing compound include quinones such as chloranil, 2,3-dichloro-1,4-naphthoquindne, 1-nitroanthraquinone, 1-chloro-5-nitroanthraquinone, 2-chloroanthraquinone, and phenanthrenequinone; aldehydes such as 4-nitrobenzaldehyde; ketones such as 9-benzoylanthracene, indandione, 3,5-dinitrobenzophenone, 2,4,7-trinitrofluorenone, 2,4,5,7-tetranitrofluorenone, and 3,3',5,5'-tetranitrobenzophenone; acid anhydrides such as phthalic anhydride and 4-chloronaphthalic anhydride; cyano compounds such as tetracyanoethylene, terephthalalmalononitrile, 9-anthrylmethylidenemalononitrile, 4-nitrobenzalmalononitrile, and 4-(p-nitrobenzoyloxy)benzalmalononitrile; and phthalides such as 3-benzalphthalide, 3-(α-cyano-p-nitrobenzal)phthalide, and 3-(α-cyano-p-nitrobenzal)-4,5,6,7-tetrachlorophthalide.

(7) Method for Forming the Photosensitive Layer

The photosensitive layer can be manufactured in accordance with a conventional method in the following manner. The charge transport material is dissolved with a binder containing a polyarylate resin in an appropriate solvent. If required, an appropriate charge generation material, sensitizing dye, electron-withdrawing compound, other charge transport materials, or known additives such as a plasticizer and a pigment are added thereto to obtain a coating solution. The resulting coating solution is then applied on an electroconductive substrate, and dried to form a photosensitive layer. In the case of the photosensitive layer comprised of two layers of the charge generation layer and the charge transport layer, the photosensitive layer can be manufactured by applying the coating solution on the charge generation layer, or forming the charge generation layer on the charge transport layer obtained by the application of the coating solution.

Examples of the solvent for preparing the coating solution include the solvents for dissolving the amine-based compounds including ethers such as tetrahydrofuran and 1,4-dioxane; ketones such as methyl ethyl ketone and cyclohexanone; aromatic hydrocarbons such as toluene and xylene; aprotic polar solvents such as N,N-dimethylformamide, acetonitrile, N-methylpyrrolidone, and dimethyl sulfoxide; esters such as ethyl acetate, methyl formate, and methyl cellosolve acetate; and chlorinated hydrocarbons such as dichloroethane and chloroform. Of course, it is necessary to select the ones capable of dissolving the binder out of these solvents.

Further, the photosensitive layer may contain known plasticizers for improving the film-forming properties, the flexibility, and the mechanical strength. Therefore, examples of the plasticizer to be added to the coating solution include aromatic compounds such as phthalic acid esters, phosphoric acid esters, epoxy compounds, chlorinated paraffins, chlorinated fatty acid ester, and methylnaphthalene. When an arylamine compound is used as the charge transport material in the charge transport layer, the coating solution may have the aforesaid composition. However, photoconductive particles, dye coloring matters, electron-withdrawing compounds and the like may be removed, or may be added only in small amounts. As the charge generation layer in this case, there may be mentioned a thin film resulting from coating and drying of the coating solution obtained by dissolving or dispersing the photoconductive particles, if required, binder polymers or other organic photoconductive substances, dye coloring matters, electron-withdrawing compounds, and the like in a solvent, or a layer formed in film by means of vapor deposition of the photoconductive particles, or the like.

(Other Protective Layer)

A protective layer may also be provided on the photosensitive layer for a purpose of preventing the wear of the photosensitive layer, or preventing or reducing the deterioration of the photosensitive layer due to the discharge product or the like arising from a charger or the like.

Further, the surface layer thereof may also contain fluorine-based resins, silicone resins, and the like for a purpose of reducing the frictional resistance or the abrasion on the surface of the photoreceptor. Further, it may also contain particles comprised of these resins, or the particles of inorganic compounds.

Further, it is needless to say that it may have, if required, a layer for improving the electric characteristics and the mechanical characteristics, including an intermediate layer such as a barrier layer, an adhesion layer, a blocking layer, or the like, a transparent insulation layer, or the like.

(Method for Forming Respective Layers)

The coating of the photosensitive layer may be accomplished by a spray coating method, a spiral coating method, a ring coating method, a dip coating method, or the like.

Examples of the spray coating method include air spray, airless spray, electrostatic air spray, electrostatic airless spray, rotation-atomization type electrostatic spray, hot spray, and hot airless spray. From the viewpoint of the atomization degree, the deposition efficiency, and the like for obtaining the uniform film thickness, in the rotation-atomization type electrostatic spray, using the conveying method as disclosed in the domestic re-publication of PCT international publication No.Hei 1-805198, that is, by continuously conveying a cylindrical work in the axial direction without causing a gap while rotating it, an electrophotographic photoreceptor excellent in the uniformity of the film thickness can be obtained with a generally high deposition efficiency.

As the spiral coating method, there are the method using a pouring-coating machine or a curtain-coating machine as disclosed in JP-A-52-119651, the method in which a paint is continuously splashed in streaks from minute openings as disclosed in JP-A-1-231966, the method using a multinozzle body as disclosed in JP-A-3-193161, or the like.

Below, the dip coating method will be described.

By using a charge transport material (preferably the foregoing compounds), a polyarylate resin, a solvent, and the like, a coating solution for forming a charge transport layer with a total solid concentration of generally from 25 to 40%, and a viscosity of generally from 50 to 300 centipoises, and preferably from 100 to 200 centipoises is prepared. Herein, in substance, the viscosity of the coating solution is determined by the type and the molecular weight of the binder polymer. However, when the molecular weight is too small, the mechanical strength of the polymer itself is reduced. Therefore, the binder polymer having such a degree of molecular weight as not to impair it is preferably used. The charge transport layer is formed by a dip coating method using the coating solution thus prepared.

Then, the film is dried, and the drying temperature and time may be adjusted so that necessary and sufficient drying is carried out. The drying temperature is generally from 100 to 250° C., preferably from 110 to 170° C., and more preferably from 120 to 140° C. Drying can be accomplished by means of a hot-air dryer, a vapor dryer, an infrared ray dryer, a far infrared ray dryer, or the like.

The electrophotographic photoreceptor thus obtained has a high sensitivity, a low residual potential, and a high triboelectricity, and shows a small variation therein due to its repeated use. Particularly, it is excellent in charging stability which affects the image concentration, and hence it can be used as a high-durability photoreceptor. Further, since it has a high sensitivity in a region of from 750 to 850 nm, it is particularly suitable for use as a photoreceptor for a semiconductor laser printer.

(Electrophotographic Apparatus)

Although electrophotographic apparatuses such as a copying machine, a printer, and the like, using the electrophotographic photoreceptor of the present invention involves at least respective processes such as charging, exposure, development, and transfer, every process may be accomplished by using any of commonly used methods. As the charging method (charger), there may be used, for example, any of corotron or scorotron electrical charging in which a corona discharge is utilized, and contact electrical charging using a conductive roller or brush, a film, or the like. Out of these techniques, in the electrical charging techniques using a corona discharge, the scorotron electrical charging is often used to hold the electrical potential in the dark place constant. As the development process, a commonly used method in which a magnetic or non-magnetic, one-component developing agent, two-component developing agent, or the like is contacted or non-contacted to carry out the development is used. As the transfer method, any of transfer by a corona discharge, the method using a transfer roller or a transfer belt, and the like may be adopted. The image transfer may be carried out directly onto a sheet of paper, an OHP film, or the like. Alternatively, an image may be transferred once onto an intermediate transfer member (in belt form or drum form), and then transferred onto a sheet of paper or an OHP film.

In general, after transfer, a fixing process for fixing the developing agent onto the sheet of paper or the like is employed. The fixing means usable may be commonly used thermal fixing or pressure fixing.

In addition to these processes, commonly used processes such as cleaning and charge removal may also be involved.

EXAMPLES

Below, the specific embodiments of the present invention will be described in more details by way of the following examples, which should not be construed as limiting the scope of the invention.

(Preparation of Polyarylate Resin)

The method for calculating the viscosity-average molecular weight of the resin obtained in each preparation example will be shown below.

[Viscosity-Average Molecular Weight]

A polyarylate resin was dissolved in dichloromethane to prepare a solution with a concentration C of 6.00 g/L. By using a Ubbellohde capillary viscometer whereby the falling time t0 of a solvent (dichloromethane) is 136.16 seconds, the falling time t of a sample solution in a thermobath set at 20.0° C. was determined. The viscosity-average molecular weight Mv was calculated in accordance with the following equation.

$$Mv=3207\times\eta 1.205$$

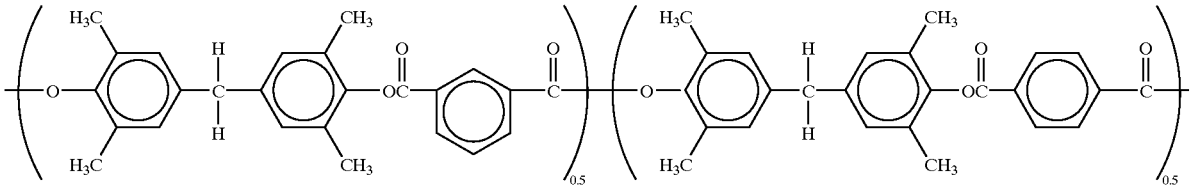

$$\eta=b/a$$

$$a=0.438\times\eta sp+1$$

$$b=100\times\eta sp/C$$

$$C=6.00\ (g/L)$$

$$\eta sp=t/t0-1$$

Preparation Example 1 (preparation of polyarylate A to be used in Example 1 and Comparative Examples 1, 2, and 4 to 6).

Sodium hydroxide (7.26 g) and $H_2O$ (600 ml) were weighed out in a 1-L beaker, and stirred and dissolved with nitrogen bubbling. Then, p-tert-butylphenol (0.3035 g), benzyltriethylammonium chloride (0.089 g), and bis(4-hydroxy-3,5-dimethylphenyl)methane[tetramethylbisphe nol F] (17.86 g) were added thereto in this order with stirring, and then the resulting alkaline aqueous solution was transferred into a 2-L reaction bath.

Separately, terephthalic acid chloride (7.22 g) and isophthalic acid chloride (7.22 g) were dissolved in dichloromethane (300 ml), and the resulting solution was transferred into a dropping funnel.

While keeping the external temperature of the polymerization bath at 20° C., and stirring the alkaline aqueous solution in the reaction bath, the dichloromethane solution was added dropwise from the dropping funnel thereto over 1 hour. Stirring was further continued for 3 hours, and then acetic acid (5 ml) and dichloromethane (100 ml) were added thereto, and stirred with water (100 ml) for 30 minutes. Thereafter, stirring was stopped to separate the organic layer. The organic layer was washed with a 0.1 N aqueous solution of sodium hydroxide (600 ml) two times, and then washed with a 0 1 N hydrochloric acid (600 ml) two times, and further washed with $H_2O$ (600 ml) two times.

The precipitate obtained by pouring the organic layer after washing in methanol was taken out by filtration, and dried to obtain the following objective polyarylate A. The viscosity-average molecular weight of the resulting polyarylate A was 37,900.

Preparation Example 2 (Preparation of Polyarylate B to be Used in Example 2)

Sodium hydroxide (7.26 g) and $H_2O$ (600 ml) were weighed out in a 1-L beaker, and stirred and dissolved with nitrogen bubbling. Then, p-tert-butylphenol (0.3035 g), benzyltriethylammonium chloride (0.089 g), and bis (4-hydroxy-3,5-dimethylphenyl) methane [tetramethylbisphe nol F] (17.86 g) were added thereto in this order with stirring, and then the resulting alkaline aqueous solution was transferred into a 2-L reaction bath.

Separately, terephthalic acid chloride (10.11 g) and isophthalic acid chloride (4.33 g) were dissolved in dichloromethane (300 ml), and the resulting solution was transferred into a dropping funnel.

While keeping the external temperature of the polymerization bath at 20° C., and stirring the alkaline aqueous solution in the reaction bath, the dichloromethane solution was added dropwise from the dropping funnel thereto over 1 hour Stirring was further continued for 3 hours, and then acetic acid (5 ml) and dichloromethane (100 ml) were added thereto, and stirred with water (100 ml) for 30 minutes. Thereafter, stirring was stopped to separate the organic layer. The organic layer was washed with a 0.1 N aqueous solution of sodium hydroxide (600 ml) two times, and then washed with a 0.1 N hydrochloric acid (600 ml) two times, and further washed with $H_2O$ (600 ml) two times.

The precipitate obtained by pouring the organic layer after washing in methanol was taken out by filtration, and dried to obtain the following objective polyarylate B. The viscosity-average molecular weight of the resulting polyarylate B was 34,300.

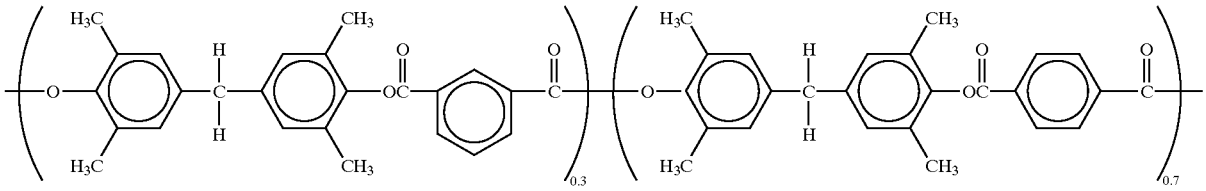

Preparation Example 3 (Preparation of Polyarylate C to be Used in Example 3)

Sodium hydroxide (7.26 g) and $H_2O$ (600 ml) were weighed out in a 1-L beaker, and stirred and dissolved with nitrogen bubbling. Then, p-tert-butylphenol (0.3035 g), benzyltriethylammonium chloride (0.089 g), and bis(4-hydroxy-3,5-dimethylphenyl)methane[tetramethylbisphe nol F] (17.86 g) were added thereto in this order with stirring, and then the resulting alkaline aqueous solution was transferred into a 2-L reaction bath.

Separately, terephthalic acid chloride (4.33 g) and isophthalic acid chloride (10.11 g) were dissolved in dichloromethane (300 ml), and the resulting solution was transferred into a dropping funnel.

While keeping the external temperature of the polymerization bath at 20° C., and stirring the alkaline aqueous solution in the reaction bath, the dichloromethane solution was added dropwise from the dropping funnel thereto over 1 hour. Stirring was further continued for 3 hours, and then acetic acid (5 ml) and dichloromethane (100 ml) were added thereto, and stirred with water (100 ml) for 30 minutes. Thereafter, stirring was stopped to separate the organic layer. The organic layer was washed with a 0.1N aqueous solution of sodium hydroxide (600 ml) two times, and then washed with a 0.1 N hydrochloric acid (600 ml) two times, and further washed with $H_2O$ (600 ml) two times.

The precipitate obtained by pouring the organic layer after washing in methanol was taken out by filtration, and dried to obtain the following objective polyarylate C. The viscosity-average molecular weight of the resulting polyarylate C was 34,700.

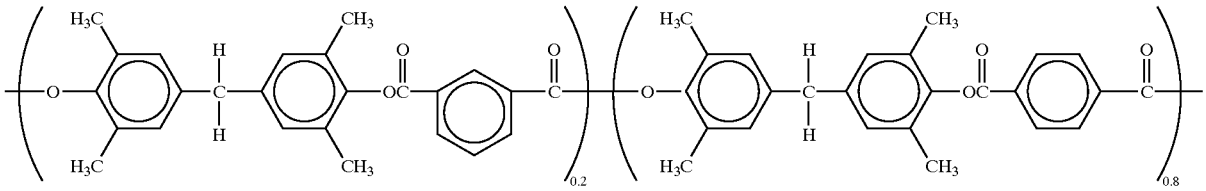

Preparation Example 4 (Preparation of Polyarylate D to be Used in Example 4)

Sodium hydroxide (7.26 g) and $H_2O$ (600 ml) were weighed out in a 1-L beaker, and stirred and dissolved with nitrogen bubbling. Then, p-tert-butylphenol (0.3035 g), benzyltriethylammonium chloride (0.089 g), and bis(4-hydroxy-3,5-dimethylphenyl)methane[tetramethylbisphe nol F] (17.86 g) were added thereto in this order with stirring, and then the resulting alkaline aqueous solution was transferred into a 2-L reaction bath.

Separately, terephthalic acid chloride (11.47 g) and isophthalic acid chloride (2.97 g) were dissolved in dichloromethane (300 ml), and the resulting solution was transferred into a dropping funnel.

While keeping the external temperature of the polymerization bath at 20° C., and stirring the alkaline aqueous solution in the reaction bath, the dichloromethane solution was added dropwise from the dropping funnel thereto over 1 hour. Stirring was further continued for 3 hours, and then acetic acid (5 ml) and dichloromethane (100 ml) were added thereto, and stirred with water (100 ml) for 30 minutes. Thereafter, stirring was stopped to separate the organic layer. The organic layer was washed with a 0.1 N aqueous solution of sodium hydroxide (600 ml) two times, and then washed with a 0.1 N hydrochloric acid (600 ml) two times, and further washed with $H_2O$ (600 ml) two times.

The precipitate obtained by pouring the organic layer after washing in methanol was taken out by filtration, and dried to obtain the following objective polyarylate D. The viscosity-average molecular weight of the resulting polyarylate D was 44,400.

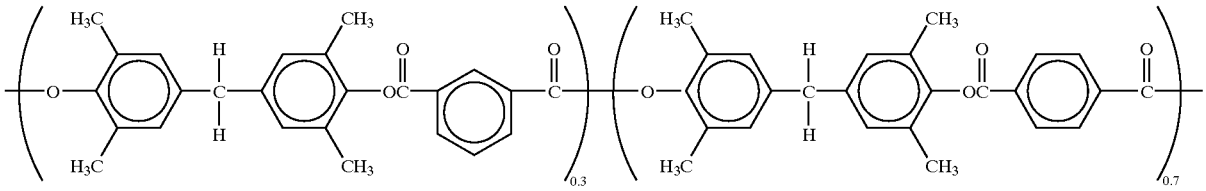

Preparation Example 5 (Preparation of Polyarylate E to be Used in Example 5)

Sodium hydroxide (13.37 g) and $H_2O$ (470 ml) were weighed out in a 1-L beaker, and stirred and dissolved with nitrogen bubbling. Then, 2,4,6-trimethylphenol (1.3448 g), benzyltriethylammonium chloride (0.1703 g), bis(4-hydroxy-3,5-dimethylphenyl)methane [tetramethylbisphe nol F] (30.06 g), and 2,2-bis (4-hydroxy-3,5-dimethylphenyl)propane [tetramethylbi sphenol A] (1.76 g) were added thereto in this order with stirring, and then the resulting alkaline aqueous solution was transferred into a 2-L reaction bath.

Separately, terephthalic acid chloride (26.10 g) was dissolved in dichloromethane (300 ml), and the resulting solution was transferred into a dropping funnel.

While keeping the external temperature of the polymerization bath at 20° C., and stirring the alkaline aqueous solution in the reaction bath, the dichloromethane solution was added dropwise from the dropping funnel thereto over 1 hour. Stirring was further continued for 3 hours, and then acetic acid (10 ml) and dichloromethane (230 ml) were added thereto, and stirred with water (100 ml) for 30 minutes. Thereafter, stirring was stopped to separate the organic layer. The organic layer was washed with a 0.1 N aqueous solution of sodium hydroxide (353 ml) two times, and then washed with a 0.1 N hydrochloric acid (353 ml) two times, and further washed with $H_2O$ (353 ml) two times.

The precipitate obtained by pouring the organic layer after washing in methanol was taken out by filtration, and dried to obtain the following objective polyarylate E. The viscosity-average molecular weight of the resulting polyarylate E was 30,200.

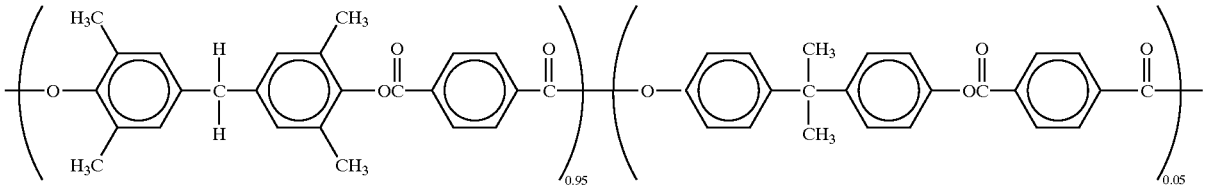

EXAMPLE 1

[Preparation of Photoreceptor]

To 10 parts by weight of oxytitanium phthalocyanine showing X-ray diffraction peaks by CuK α rays at Bragg angles (2θ+0.20) of 9.3°, 13.2°, 26.2°, and 27.1°, was added 200 parts by weight of n-propanol, and the mixture was ground in a sand grinding mill for 10 hours to perform the atomization dispersion treatment. Then, the resulting mixture was mixed with a 10% methanol of 5 parts by weight of polyvinyl butyral (manufactured by Denki Kagaku Kogyo K.K., trade name "Denka Butyral" #6000C) to form a dispersion. Then, the resulting dispersion was coated by a bar coater on the aluminum vapor deposited surface of a polyester film so that the film thickness after drying is 0.4 μm to provide a charge generation layer. On the charge generation layer, a solution of 60 parts by weight of the charge transport material (1) shown above, and 100 parts by weight of the polyarylate A obtained in Preparation Example 1 dissolved in 1000 parts by weight of tetrahydrofuran/toluene mixed solution was coated by a film applicator so that the film thickness after drying is 20 μm to provide a charge transport layer. Thus, a photoreceptor was prepared.

[Friction Test]

Toner was uniformly provided on the photoreceptor manufactured as described above so as to achieve 0.1 mg/cm$^2$, and an urethane rubber cut into a 1-cm-wide piece, made of the same material as that for a cleaning blade was used at 45 degrees as the surface to be contacted. The coefficient of kinetic friction for the one hundredth cycle when the urethane rubber had been traveled with a load of 200 g, a velocity of 5 mm/sec, and a stroke of 20 mm 100 times was determined by means of a Fully Automatic Friction Abrasion Testing Machine DFPM-SS manufactured by Kyowa Interface Science Co., Ltd. The results are shown in Table 3.

[Abrasion Test]

A photoreceptor film was cut in circle with a diameter of 10 cm to carry out the abrasion evaluation by means of a Taber abrader (manufactured by Toyo Seiki Seisakusyo K.K.). Under the test conditions of 23° C., and 50% RH atmosphere, using a truck wheel CS-10F, and no load (the truck wheel's own weight), the abrasion amount after 100 revolutions was determined by comparing the weights before and after the test. The results are shown in Table 3.

[Electric Characteristics]

By using an electrophotographic characteristic evaluation apparatus (described on pages 404 to 405 in "Electrophotography—Bases and applications, second series" edited by the Society of Electrophotography, published by Corona Co.), manufactured in accordance with the measurement standard by the Society of Electrophotography, a test was carried out in the following manner. The photoreceptor was stuck on a drum made of aluminum to be formed in cylinder, and the continuity between the drum made of aluminum and the aluminum substrate of the photoreceptor was ensured. Then, the drum was rotated at a constant rpm to perform the electric characteristic evaluation test by cycles of charging, exposure, potential measurement, and charge removal. In this step, the initial surface potential was set at −700 V, and exposure was carried out by using a 780-nm monochromatic light (exposure energy: 10 gW/Cm$^2$), and the charge removal was carried out by using a 660-nm monochromatic light. The evaluation items to be determined were the amount of light exposure required for the surface potential to be reduced by half from 700 V to 350 V (half decay exposure, E1/2), and the surface potential when the exposure time was set at 9.9 seconds (residual potential, Vr). The measurements were carried out under the environment of a temperature of 5° C. and a relative humidity of 10% or less. The results are shown in Table 1.

[Mobility]

The Hole mobilities of the resulting photoreceptors at 5° C. and 21° C. in an electric field of $3\times10^5$ (V/cm) were determined by a TOF (Time-of-flight) method. The results are shown in Table 1.

[Polarizability and Dipole Moment of Charge Transport Material]

The polarizability α and the dipole moment P of the compound (1), used in the charge transport layer were determined in accordance with the method described on page 3572, vol. 75 (1981) of "Journal of Chemical Physics". Further, the calculated value αcal of the polarizability and the calculated value Pcal of the dipole moment were determined by utilizing MOPAC93. The results are shown in Table 1.

COMPARATIVE EXAMPLE 1

A photoreceptor was manufactured and evaluated in the same manner as in Example 1, except that 60 parts by weight of the charge transport material (1) in Example 1 was changed into 60 parts by weight of a compound having the following structure. The results are shown in Table 1.

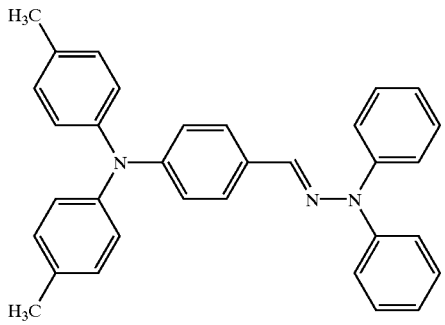

COMPARATIVE EXAMPLE 2

A photoreceptor was manufactured and evaluated in the same manner as in Example 1, except that 60 parts by weight of the charge transport material (1) in Example 1 was changed into 60 parts by weight of N-methylcarbazole-3-carbaldehydediphenylhydrazone. The results are shown in Table 1.

COMPARATIVE EXAMPLE 3

A photoreceptor was manufactured and evaluated in the same manner as in Example 1, except that the amount of the charge transport material (1) was changed into 40 parts by weight, and the polyarylate A was changed into a polycarbonate having the following structure in Example 1. The results are shown in Table 1.

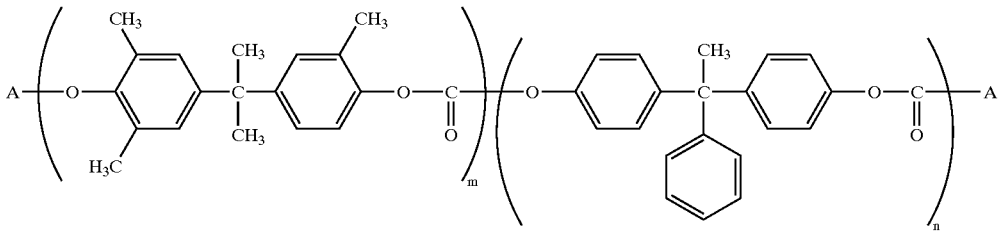

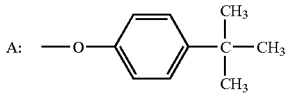

EXAMPLE 2

A photoreceptor was manufactured and evaluated in the same manner as in Example 1, except that the polyarylate A in Example 1 was changed into the polyarylate B obtained in Preparation Example 2. The results are shown in Table 1.

EXAMPLE 3

A photoreceptor was manufactured and evaluated in the same manner as in Example 1, except that the polyarylate A in Example 1 was changed into the polyarylate C obtained in Preparation Example 3. The results are shown in Table 1.

EXAMPLE 4

A photoreceptor was manufactured and evaluated in the same manner as in Example 1, except that the polyarylate A in Example 1 was changed into the polyarylate D obtained in Preparation Example 4. The results are shown in Table 1.

EXAMPLE 5

A photoreceptor was manufactured and evaluated in the same manner as in Example 1, except that the polyarylate A in Example 1 was changed into the polyarylate E obtained in Preparation Example 5. The results are shown in Table 1.

COMPARATIVE EXAMPLE 4

A photoreceptor was manufactured and evaluated in the same manner as in Example 1, except that 60 parts by weight of the charge transport material (1) in Example 1 was changed into 95 parts by weight of the following charge transport material. The results are shown in Table 1.

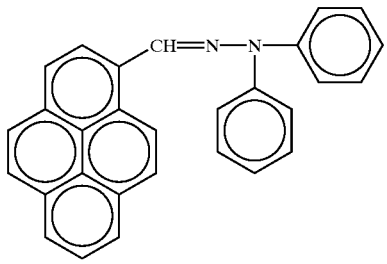

COMPARATIVE EXAMPLE 5

A photoreceptor was manufactured and evaluated in the same manner as in Comparative Example 4, except that 95 parts by weight of the charge transport material in Comparative Example 4 was changed into 60 parts by weight of the same material. The results are shown in Table 1.

COMPARATIVE EXAMPLE 6

A photoreceptor was manufactured and evaluated in the same manner as in Comparative Example 5, except that oxytitanium phthalocyanine, i.e., the charge generation material in Comparative Example 5, was changed into a bisazo compound represented by the following structural formula. The results are shown in Table 1.

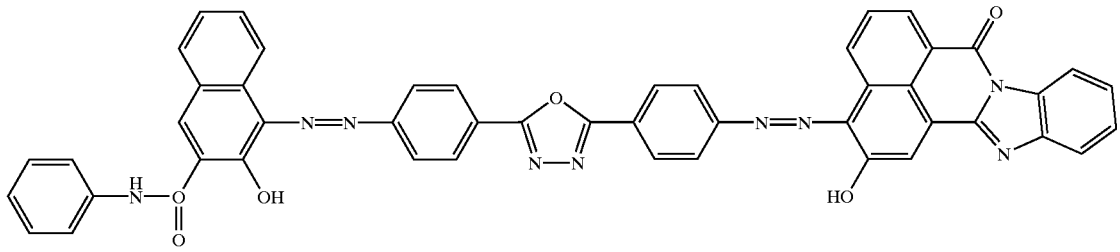

TABLE 1

| | Polarizability (Å$^3$) | | Dipole moment D | | Half decay | Residual | | Amount | | |
|---|---|---|---|---|---|---|---|---|---|---|
| | Measured value | Calculated value | Measured value | Calculated value | exposure E1/2 | potential Vr | Coefficient | of abrasion | Mobility ($10^{-6}$ cm$^2$/Vs) | |
| | α | αcal | P | P cal | (μJ/cm$^2$) | (V) | of friction | (g) | 21° C. | 5° C. |
| Example 1 | 129 | 93.7 | 1.3 | 0.79 | 0.48 | 39 | 0.51 | 4.9 | 4.0 | 1.1 |
| Comparative Example 1 | 65 | 47 | 2.5 | 2.3 | 0.60 | 82 | 0.47 | 3.5 | 1.4 | 0.35 |
| Comparative Example 2 | 58 | 41 | 2.7 | 2.2 | 0.55 | 90 | 0.52 | 4.4 | 0.41 | 0.15 |
| Comparative Example 3 | Same as in Example 1 | | | | 0.46 | 24 | 0.62 | 11.0 | 12 | 6.6 |
| Example 2 | Same as above | | | | 0.52 | 31 | 0.47 | 4.3 | 8.2 | 3.4 |
| Example 3 | Same as above | | | | 1.5 | 135 | 0.47 | 5.0 | 1.7 | 0.45 |
| Example 4 | Same as above | | | | 0.50 | 30 | 0.48 | 3.1 | 11 | 3.6 |
| Example 5 | Same as above | | | | 0.52 | 26 | 0.51 | 4.0 | 13 | 6.7 |
| Comparative Example 4 | 62.3 | 46.2 | 2.48 | 2.2 | Unmeasured | 368 | 0.45 | 6.0 | 1.8 | 0.45 |
| Comparative Example 5 | Same as above | | | | Unmeasured | 469 | 0.47 | 3.9 | 0.54 | 0.12 |
| Comparative Example 6 | Same as above | | | | 3.3 | 107 | 0.45 | 3.6 | 0.54 | 0.12 |

EXAMPLE 6

A photoreceptor was manufactured and evaluated in the same manner as in Example 1, except that the amount of the charge transport material. (1) was changed from 60 parts by weight into 40 parts by weight, and 25 parts by weight of the polycarbonate resin used in Comparative Example 3 and 75 parts by weight of the polyarylate resin A were used in place of 100 parts by weight of the polyarylate A in Example 1. The results are shown in Table 2. It is noted that the evaluation of the electric characteristics was carried out in the following manner.

[Electric Characteristics]

By using an electrophotographic characteristic evaluation apparatus (described on pages 404 to 405 in "Electrophotography—Bases and applications, second series" edited by the Society of Electrophotography, published by Corona Co.), manufactured in accordance with the measurement standard by the Society of Electrophotography, a test was carried out in the following manner. The photoreceptor was stuck on a drum made of aluminum to be formed in cylinder, and the continuity between the drum made of aluminum and the aluminum substrate of the photoreceptor was ensured. Then, the drum was rotated at a constant rpm to perform the electric characteristic evaluation test by cycles of charging, exposure, potential measurement, and charge removal. In this step, the initial surface potential was set at −700 V, and exposure was carried out by using a 780-nm monochromatic light, and the charge removal was carried out by using a 660-nm monochromatic light. The evaluation items to be determined were the amount of exposure light required for the surface potential to be reduced by half from 700 V to 350 V (half decay exposure, E1/2), and the surface potential (VL) when a 780-nm light was applied thereto at 2.4 μJ/cm$^2$. In the VL measurement, the length of time required for exposure-potential measurement was set to be 139 ms. The measurements were carried out under the environment of a temperature of 5° C. and a relative humidity of 10% or less.

EXAMPLE 7

A photoreceptor was manufactured and evaluated in the same manner as in Example 6, except that the amount of the polycarbonate resin was changed into 50 parts by weight, and the amount of the polyarylate resin was changed into 50 parts by weight in Example 6. The results are shown in Table 2.

COMPARATIVE EXAMPLE 7

A photoreceptor was manufactured and evaluated in the same manner as in Example 7, except that the charge transport material used in Comparative Example 1 was used in place of the charge transport material (1) used in Example 7. The results are shown in Table 2.

EXAMPLE 8

A photoreceptor was manufactured in the same manner as in Example 6, except that the amount of the charge transport material (1) in Example 6 was changed into 60 parts by weight, and the mobility thereof was determined by a TOF method. The results are shown in Table 3.

EXAMPLE 9

A photoreceptor was manufactured in the same manner as in Example 7, except that the amount of the charge transport material (1) in Example 7 was changed into 60 parts by weight, and the mobility thereof was determined by a TOF method. The results are shown in Table 3.

TABLE 2

| | Polarizability (Å$^3$) | | Dipole moment D | | Half decay exposure | Surface potential | | Amount of |
|---|---|---|---|---|---|---|---|---|
| | Measured value α | Calculated value αcal | Measured value P | Calculated value Pcal | E1/2 (μJ/cm$^2$) | VL (V) | Coefficient of friction | abrasion (g) |
| Example 6 | Same as in Example 1 | | | | 0.64 | 220 | 0.52 | 4.0 |
| Example 7 | Same as above | | | | 0.54 | 159 | 0.57 | 5.0 |
| Comparative Example 7 | Same as in Comparative Example 1 | | | | 0.56 | 207 | 0.53 | 4.6 |

TABLE 3

| | Polarizability (Å$^3$) | | Dipole moment D | | Mobility ($10^{-6}$ cm$^2$/Vs) | |
|---|---|---|---|---|---|---|
| | Measured value α | Calculated value αcal | Measured value P | Calculated value Pcal | 21° C. | 5° C. |
| Example 8 | Same as in Example 1 | | | | 12 | 3.3 |
| Example 9 | Same as above | | | | 22 | 5.8 |

While the invention has been described in detail and with reference to specific embodiments thereof, it will be apparent to one skilled in the art that various changes and modifications can be made therein without departing from the spirit and scope thereof.

This application is based on Japanese patent applications No. Hei-11-360590 filed on Dec. 20, 1999, No. 2000-44314 filed on Feb. 22, 2000 and No. 2000-65896 filed on Mar. 10, 2000, the entire contents of which incorporated herein by reference.

What is claimed is:

1. An electorphotographic photoreceptor having at least a photosensistive layer on an electroconductive substrate, wherein the photosensitive layer contains a charge transport material having α polarizability α satisfying:

$$\alpha > 100\ (\text{Å}^3)$$

and a polyarylate resin.

2. The electrophotographic photoreceptor according to claim 1, wherein the charge transport material has a dipole moment P of the formula:

$$P < 1.6(D).$$

3. The electrophotographic photoreceptor according to claim 1, wherein the polyarylate resin does not have a nitrogen atom in its repeating unit.

4. The electrophotographic photoreceptor according to claim 3, wherein the polyarylate resin has the following formula (2):

(2)

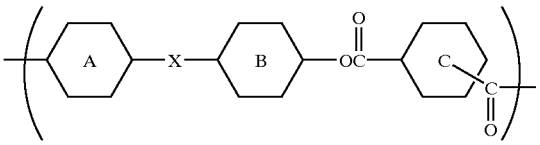

wherein rings A, B, and C each represent a benzene ring which may have 1 to 4 substituents, and X represents a divalent organic group.

5. The electrophotographic photoreceptor according to claim 4, wherein the polyarylate resin of formula (2) has structural units of at least one of the following formulae (3) and (4):

(3)

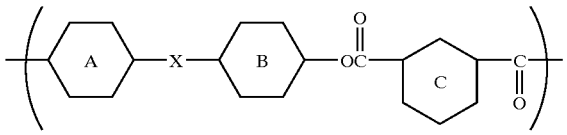

(4)

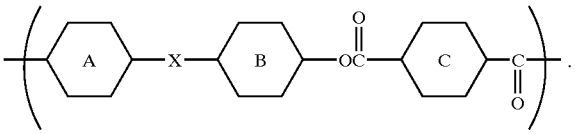

6. The electrophotographic photoreceptor according to claim 5, wherein m represents the molar ratio of the structural units of formula (3), and n represents the molar ratio of the structural units of formula (4), and wherein the molar ratios satisfy the following formula:

$$0.5 \leq n/(m+n) \leq 1.$$

* * * * *